US011214990B2

(12) United States Patent
Yoshino et al.

(10) Patent No.: US 11,214,990 B2
(45) Date of Patent: Jan. 4, 2022

(54) HANDLE APPARATUS FOR VEHICLE

(71) Applicant: AISIN SEIKI KABUSHIKI KAISHA, Kariya (JP)

(72) Inventors: Masaki Yoshino, Chita-gun (JP); Koya Sasaki, Anjo (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 740 days.

(21) Appl. No.: 16/100,529

(22) Filed: Aug. 10, 2018

(65) Prior Publication Data

US 2019/0055761 A1 Feb. 21, 2019

(30) Foreign Application Priority Data

Aug. 15, 2017 (JP) ..... JP2017-156722

(51) Int. Cl.
*E05B 79/06* (2014.01)
*E05B 85/16* (2014.01)
*E05B 17/00* (2006.01)

(52) U.S. Cl.
CPC ..... *E05B 79/06* (2013.01); *E05B 85/16* (2013.01); *E05B 17/0012* (2013.01)

(58) Field of Classification Search
CPC ..... E05B 79/06; E05B 85/16; E05B 17/0012; E05B 77/06; Y10S 292/53; Y10T 292/57
USPC ..... 292/DIG. 64
See application file for complete search history.

(56) References Cited

U.S. PATENT DOCUMENTS 6,672,633 B2 * 1/2004 Nomura ..... E05B 79/06 292/336.3
9,151,090 B2 * 10/2015 Beck ..... E05B 85/14
9,708,836 B2 * 7/2017 Corwin ..... E05B 77/06
2020/0277811 A1 * 9/2020 Yamada ..... E05B 79/06

FOREIGN PATENT DOCUMENTS

JP 2003-41811 2/2003
JP 2015-4220 1/2015

* cited by examiner

*Primary Examiner* — Kristina R Fulton
*Assistant Examiner* — Noah Horowitz
(74) *Attorney, Agent, or Firm* — Oblon, McClelland, Maier & Neustadt, L.L.P.

(57) ABSTRACT

A handle apparatus for a vehicle includes a support member, a bell crank rotatable between an initial position and an operation position and causing the lock apparatus to be in a latched state and in an unlatched state, and a handle including a pressing portion. In a state where the pressing portion is in contact with a pressed portion provided at the bell crank, the handle causes, via the pressed portion and the pressing portion, the bell crank to rotate between the initial position and the operation position when the handle rotates. The apparatus includes a temporary hold member supported by the bell crank in such a manner that the temporary hold member is slidable between a first position and a second position, and the temporary hold member includes an engagement portion configured to engage with and disengage from an engaging portion provided at the support member.

10 Claims, 13 Drawing Sheets

HANDLE APPARATUS FOR VEHICLE

CROSS REFERENCE TO RELATED APPLICATIONS

This application is based on and claims priority under 35 U.S.C. § 119 to Japanese Patent Application 2017-156722, filed on Aug. 15, 2017, the entire content of which is incorporated herein by reference.

TECHNICAL FIELD

This disclosure generally relates to a handle apparatus for a vehicle.

BACKGROUND DISCUSSION

A known handle apparatus disclosed in JP2003-41811A (which will be hereinafter referred to as Patent reference 1) is fixed to a vehicle door supported at a vehicle body so as to be relatively movable. The known handle apparatus includes a support member (frame) corresponding to a base member, and an outside handle (outer handle).

A vehicle outer-side surface of the vehicle door is formed of an outer panel. The support member is fixed to a vehicle inner-side surface of the outer panel. The support member is provided with an engaging portion (lock portion). The support member is also provided with a rotary support portion (support portion) and an adjacent space portion (an insertion port) which is adjacent to the rotary support portion.

Most part of the outside handle is positioned at the vehicle outer side relative to the outer panel. The outside handle includes a rotary shaft (engaging portion) and a pressing arm (insertion protrusion) extended towards a vehicle inner side. The rotary shaft is positioned at the vehicle inner side of the outer panel by passing through a through hole formed at the outer panel, and the rotary shaft is rotatably supported by the rotary support portion of the support member. Thus, the outside handle is rotatable about the rotary shaft between a first initial position and a first operation position, relative to the support member. The pressing arm is positioned at the vehicle inner side relative to the outer panel by passing through a through hole formed at the outer panel. A pressing portion is formed at a vehicle inner-side end portion (distal end portion) of the pressing arm.

A bell crank (handle lever) is supported by the support member to be rotatable about an axis extended in the horizontal direction and to be slidable in the horizontal direction (front-and-rear direction). The bell crank is rotatable between a second initial position (initial position) and a second operation position (operation position), relative to the support member. The bell crank is slidable between a no-hold portion and a temporary hold position, relative to the support member. The bell crank is biased by a bell crank biasing member to rotate towards the no-hold portion and towards the second initial position. The bell crank biasing member is provided between the bell crank and the support member. The bell crank includes a pressed portion and an engagement tab.

When the rotary shaft of the outside handle is rotatably supported by the rotary support portion of the support member and the pressing portion of the pressing arm is in contact (engages) with the pressed portion of the bell crank from the vehicle inner side, movement of the outside handle and movement of the bell crank are associated or linked with each other. That is, the bell crank is at the second initial position when the outside handle is positioned at the first initial position, and the bell crank is positioned at the second operation position when the outside handle is positioned at the first operation position.

The vehicle door is provided with a lock apparatus. The lock apparatus is connected to the bell crank via a linkage rod corresponding to a linkage member. Thus, when the outside handle is positioned at the first initial position and thus the bell crank is at the second initial position, the lock apparatus is in a latched state and restricts the vehicle door from performing an opening operation relative to the vehicle body. To the contrary, when the outside handle is positioned at the first operation position and thus the bell crank is at the second operation position, the lock apparatus is in an unlatched state and allows the vehicle door to perform the opening operation relative to the vehicle body.

To assemble the above-described known handle apparatus, first, an operator places the bell crank, which is integral with the support member separated from the outer panel, at an assembly position that is a predetermined rotational direction position between the second initial position and the second operation position with, for example, his or her hands against a biasing force of the bell crank biasing member. Further, the operator slides, against the biasing force of the bell crank biasing member, the bell crank to the temporary hold position. Thus, the engagement tab of the bell crank engages with the engaging portion of the support member. Accordingly, even if the operator releases his or her hand off the bell crank, a sliding direction position of the bell crank is kept at the temporary hold position and the rotational direction position of the bell crank is temporarily kept at the assembly position. At this time, the outside handle is positioned at a predetermined position between the first initial position and the first operation position.

Next, while the bell crank is maintained in the above-described state, the support member is fixed to the vehicle inner-side surface of the outer panel. The bell crank may be temporarily held at the temporary hold position and the assembly position after the support member is fixed to the vehicle inner-side surface of the outer panel.

Next, the rotary shaft and the pressing arm of the outside handle that is positioned at the vehicle outer side of the outer panel and is separated from the support member is made to pass through the through hole and be positioned at the vehicle inner side of the outer panel. Further, the rotary shaft is positioned in the adjacent space portion formed at the support member and the pressing portion of the pressing arm is made to come close to the pressed portion of the bell crank.

Subsequently, the pressing portion of the pressing arm is made to face the pressed portion of the bell crank from the vehicle inner side. When the bell crank and the outside handle are in the above-described positional relation, the outside handle can move relative to the support member (outer panel) so that the rotary shaft positioned in the adjacent space portion moves towards the rotary support portion. In other words, the rotary shaft of the outside handle comes to be movable towards the rotary support portion without the outside handle interfering with the bell crank. Thus, the rotary shaft of the outside handle is rotatably supported by the rotary support portion of the support member. Further, the pressing portion of the pressing arm is in contact with the pressed portion of the bell crank from the vehicle inner side.

When the rotational direction position of the bell crank is positioned at the second initial position, if the outside handle is made to move relative to the support member so that the rotary shaft positioned in the adjacent space portion moves towards the rotary support portion, the outside handle interferes with the bell crank. That is, the outside handle cannot move relative to the support member in such a manner that the rotary shaft is supported by the rotary support portion.

Then, the outside handle is made to rotate to the first operation position after the rotary shaft of the outside handle comes to be supported by the rotary support portion of the support member and the pressing portion of the pressing arm comes in contact with the pressed portion of the bell crank from the vehicle inner side. Thus, the pressing portion of the pressing arm that has moved towards the vehicle inner side presses the pressed portion of the bell crank towards the vehicle inner side, and accordingly the bell crank rotates from the assembly position to the second operation position. Thus, the engagement tab of the bell crank disengages from the engaging portion of the support member. Consequently, due to the biasing force of the bell crank biasing member, the sliding direction position of the bell crank shifts towards the no-hold portion and the rotational direction position becomes the second initial position.

The known outside handle is rotatably attached to the support member in the above-described procedures.

As is known, the lock apparatus includes a striker fixed to a vehicle body, a latch engaging with and disengaging from the striker and a pawl engaging with and disengaging from the latch. The lock apparatus further includes a latch biasing member biasing the latch such that the latch rotates in a direction in which the latch releases the striker and a pawl biasing member biasing the pawl such that the pawl rotates in a direction in which the pawl engages with the latch. Further, the linkage rod linked to the bell crank is connected to a pawl linkage member (open lever) serving as a component of the lock apparatus and linked to the pawl.

After completion of the attachment of the rotary shaft of the outside handle to the rotary support portion of the support member, when the outside handle positioned at the first initial position is rotated towards the first operation position, force is transmitted from the bell crank that has rotated towards the second operation position to the pawl linkage member via the linkage rod. Thus, a reaction force including the respective biasing forces of the latch biasing member and the pawl biasing member of the lock apparatus is transmitted from the linkage rod to the bell crank. The reaction force will be hereinafter referred to as a bell crank operation force.

When a positional relation of the lock apparatus and the handle apparatus to each other is in a predetermined positional relation, a direction of part of component force of the bell crank operation force may coincide with the moving direction of the bell crank from the no-hold position to the temporary hold position. Further, the component force may become larger than the biasing force with which the bell crank biasing member moves the bell crank towards the no-hold position. Thus, in such a case, the bell crank moves unintentionally to the temporary hold position due to the component force of the bell crank operation force. Consequently, when the operator releases his or her hand from the outside handle and accordingly the outside handle rotates from the first operation position towards the first initial position, the engagement tab of the bell crank unintentionally engages with the engagement portion of the support member when the bell crank has rotated from the second operation position to the assembly position. That is, the outside handle cannot be rotated to return to the first initial position (the bell crank cannot be rotated to return to the second initial position).

A need thus exists for a handle apparatus for a vehicle which is not susceptible to the drawback mentioned above.

SUMMARY

According to an aspect of this disclosure, a handle apparatus for a vehicle includes a support member configured to be fixed to a vehicle door including a lock apparatus, and a bell crank supported by the support member to be rotatable between an initial position and an operation position. In a state where the bell crank is linked to the lock apparatus, the bell crank causes the lock apparatus to be in a latched state when the bell crank is in the initial position and causes the lock apparatus to be in an unlatched state when the bell crank is in the operation position. The latched state is configured to hold the vehicle door in a closed state and the unlatched state is configured to permit the vehicle door to open. The apparatus includes a handle including a pressing portion, and in a case where the handle is rotatably attached to the support member in a state where the pressing portion is in contact with a pressed portion provided at the bell crank, the handle causes, via the pressed portion and the pressing portion, the bell crank to rotate between the initial position and the operation position when the handle rotates. The apparatus includes a temporary hold member supported by the bell crank in such a manner that the temporary hold member is slidable between a first position and a second position and that the temporary hold member is biased to move to the first position, and the temporary hold member includes an engagement portion configured to engage with and disengage from an engaging portion provided at the support member when the temporary hold member is in the second position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
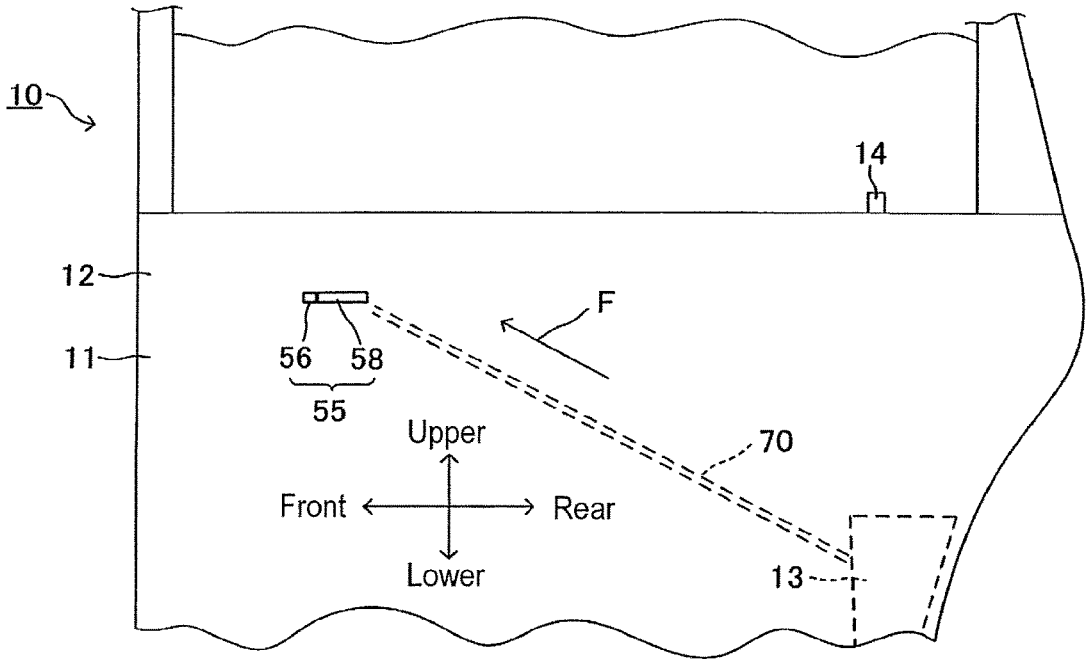
FIG. 1 is a side view of a vehicle door of an embodiment disclosed here, which is seen from a vehicle outer side.
Figure 2:
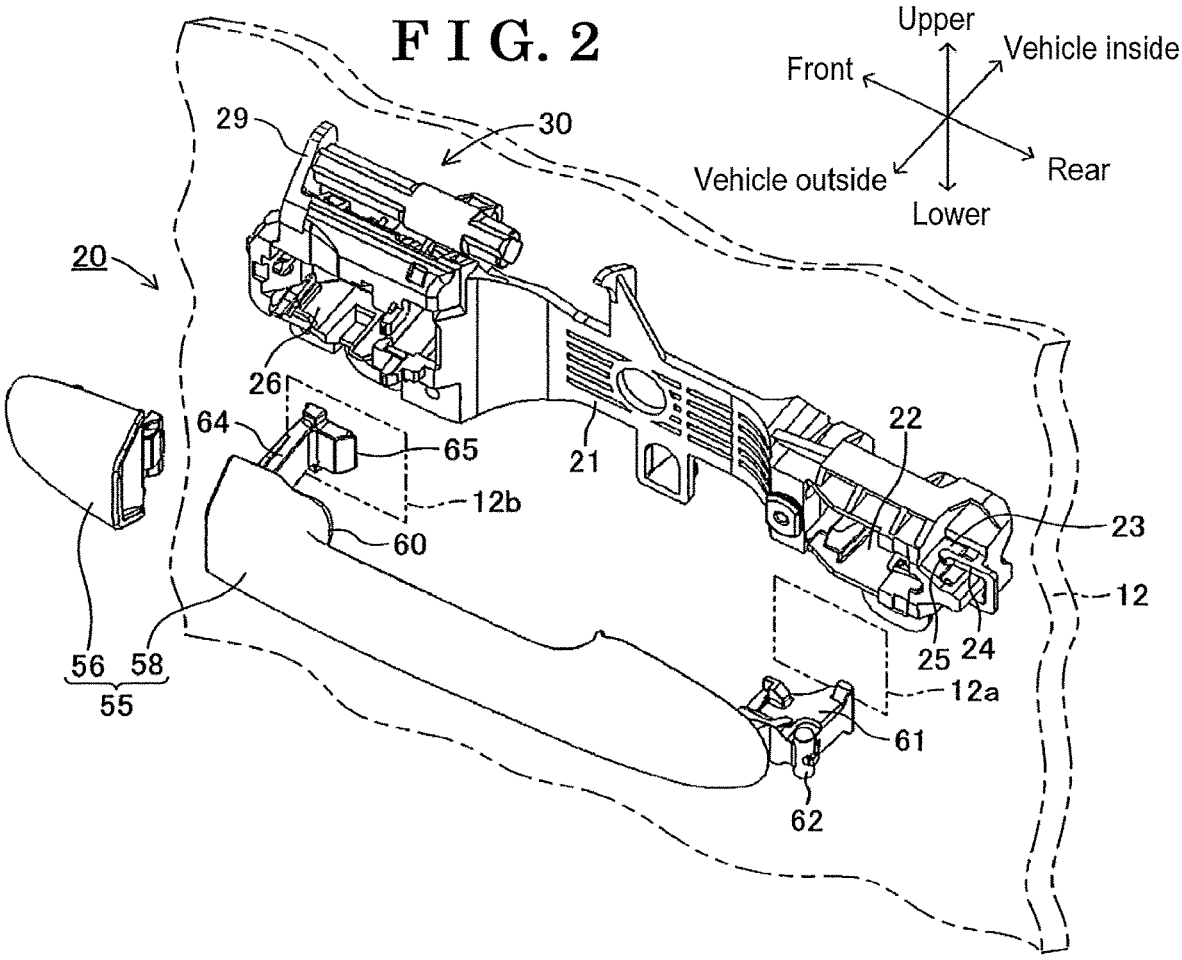
FIG. 2 is an exploded perspective view of a support member that is integral with a bell crank unit, an outer panel, and an outside handle, which is seen from the vehicle outer side.

An embodiment disclosed here will be explained with reference to the drawings. The directions explained below correspond to the directions of the arrows shown in the drawings. A vehicle door 10 illustrated in FIG. 1 is configured to be supported at a vehicle body to be slidable in a front and rear direction relative to the vehicle body, and the vehicle door 10 is configured to open and close an opening portion formed at a side surface of the vehicle body. The vehicle door 10 of the embodiment is a side door on the left side. A door main body 11 forms a substantially lower half of the vehicle door 10, and a vehicle outer-side surface of the door main body 11 is formed of an outer panel 12 formed of metal plate. As illustrated in FIG. 2, assembly through holes 12*a* and 12*b* are provided at a front upper portion of the outer panel 12 as a pair arranged in the front and rear direction. A lock apparatus 13 is provided at an inner portion of the vehicle door 10, and part of the lock apparatus 13 is exposed at a rear end surface of the vehicle door 10. The lock apparatus 13 is a known lock apparatus including a latch, a pawl (lift lever), an open link and an outside open lever. The latch and the pawl are biased in a specified direction to rotate, by a biasing force of a spring. The lock apparatus 13 (the open link of the lock apparatus 13) is linked to a lock knob 14. The lock knob 14 is provided at an upper end surface of a trim forming a vehicle inner-side surface of the vehicle door 10 such that the lock knob 14 is slidable in an upper and lower direction. The lock knob 14 is movable in the upper and lower direction between an unlock position (the position shown in FIG. 1) and a lock position which is lower than the unlock position. The lock apparatus 13 is linked to a handle apparatus 20 including an outside handle 55 which is rotatable relative to the outer panel 12.

The configuration of the handle apparatus 20 will be described in detail. The handle apparatus 20 includes, as components thereof, a support member 21, a bell crank unit 30 and the outside handle 55.

Figure 3:
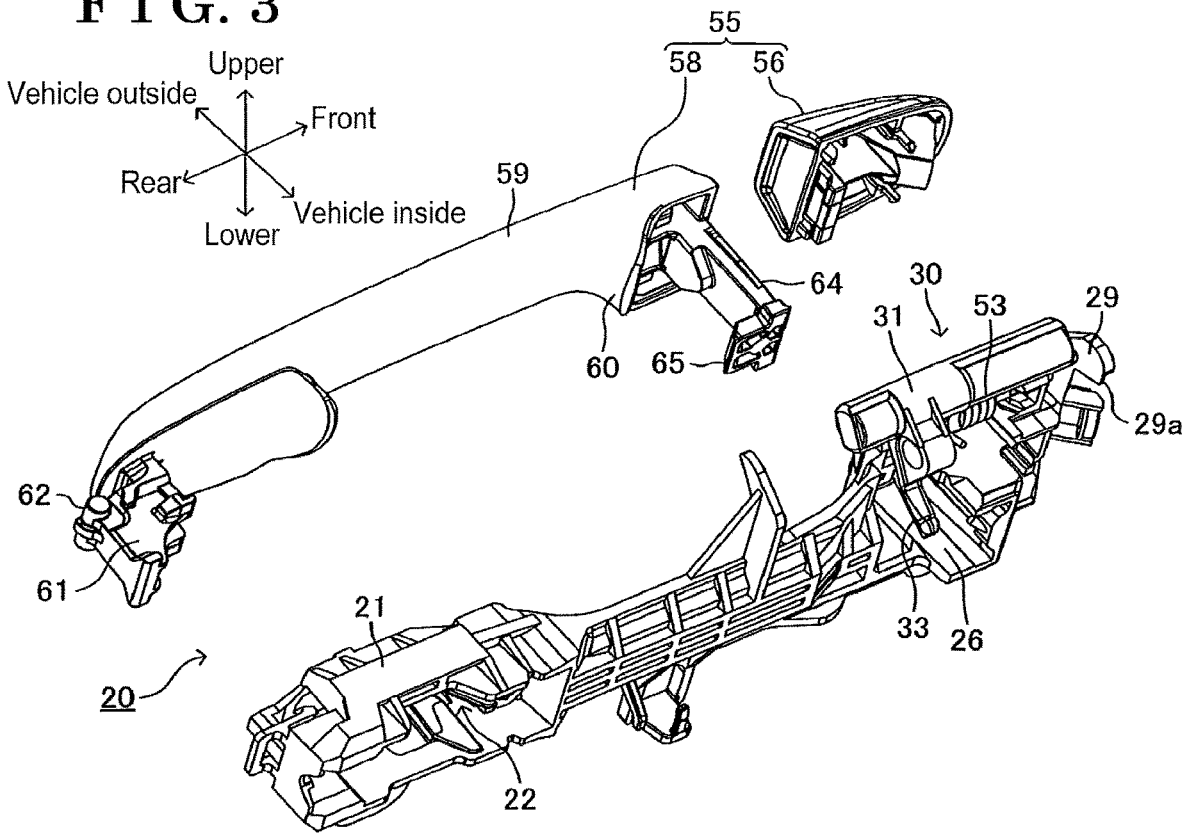
FIG. 3 is an exploded perspective view of the support member that is integral with the bell crank unit, and the outside handle, which is seen from a vehicle inner side.
Figure 4:
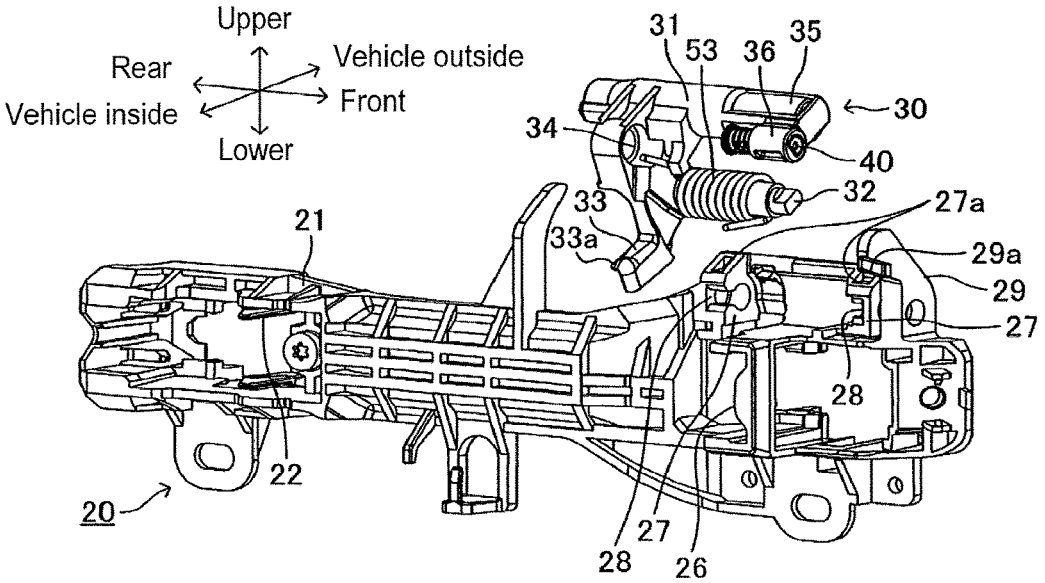
FIG. 4 is an exploded perspective view of the bell crank unit and the support member, which is seen from the vehicle inner side.
Figure 5:
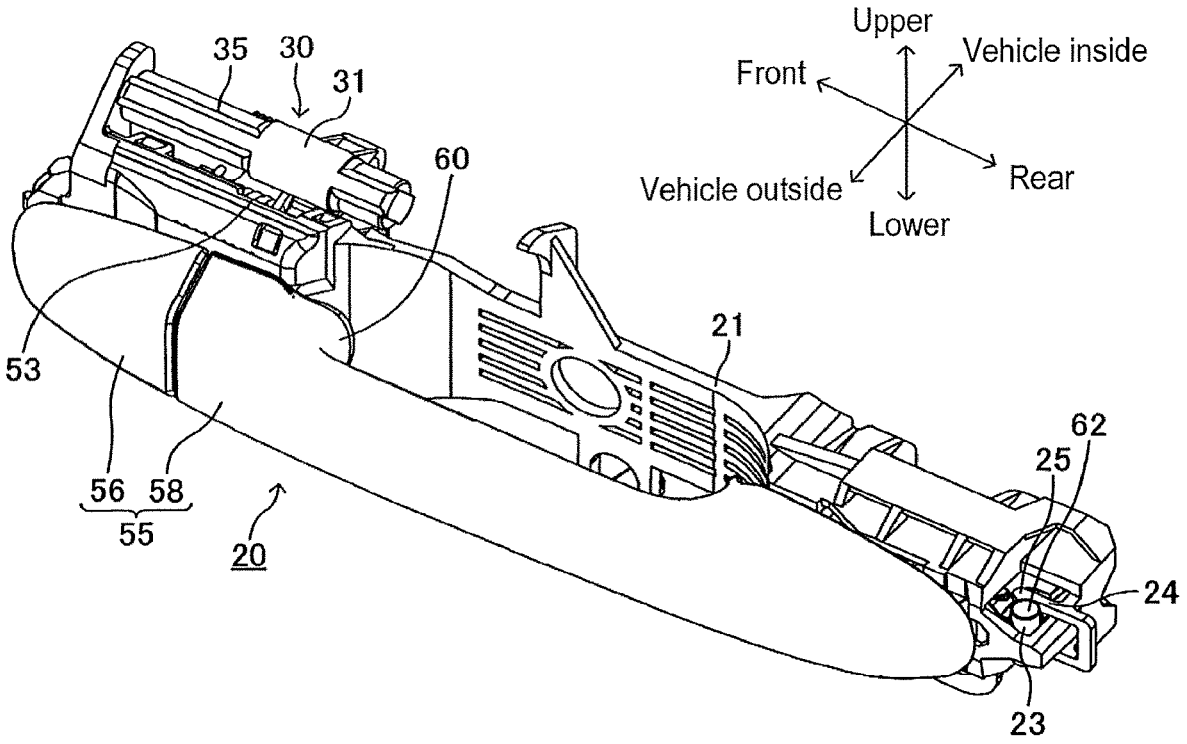
FIG. 5 is a perspective view of the support member, the bell crank unit and the outside handle which are integral with one another, which is seen from the vehicle outer side.
Figure 28:
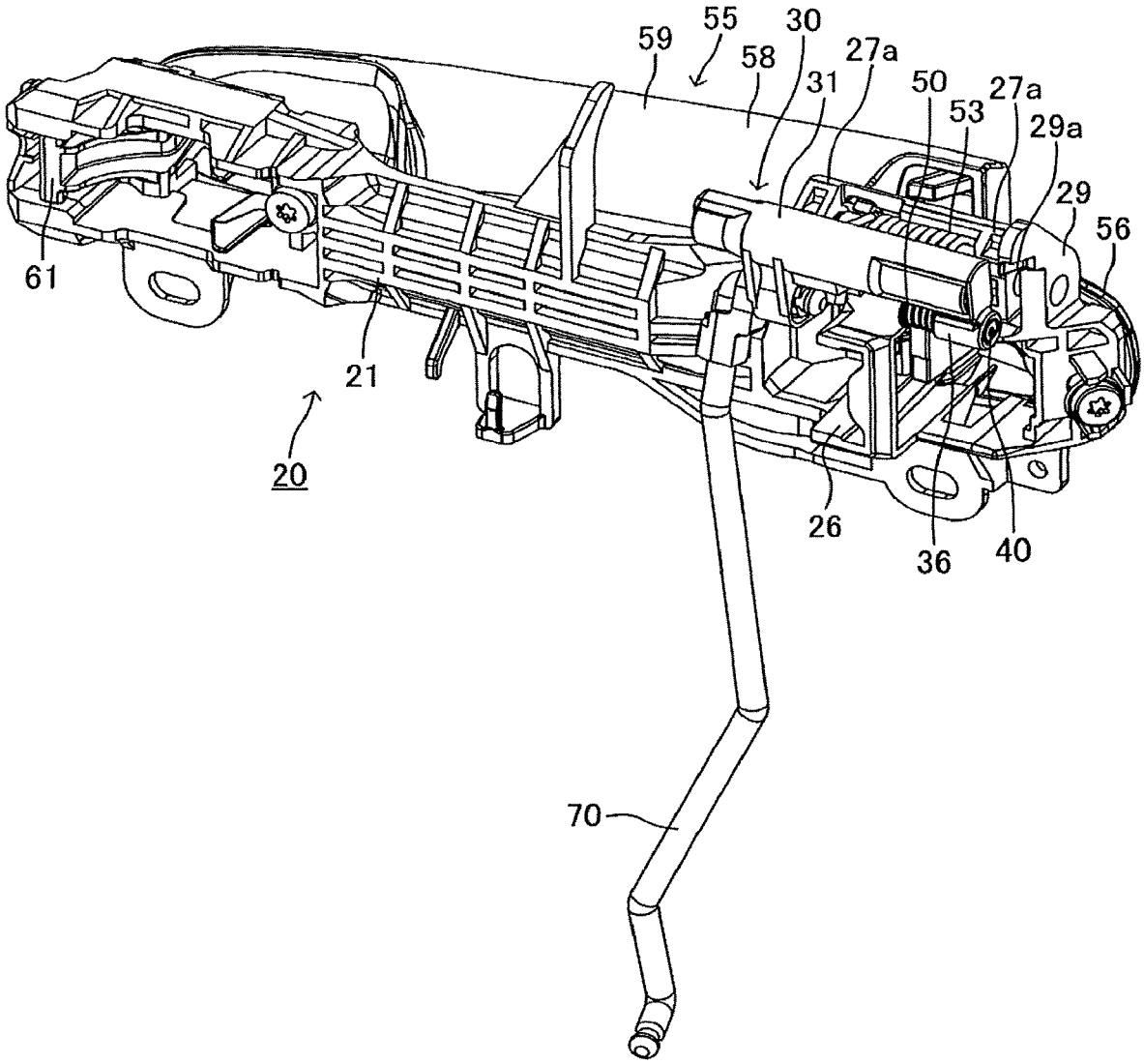
FIG. 28 is a perspective view of the handle apparatus when the bell crank which was positioned at the assembly position has been rotated to a second operation position by placing the outside handle at a first operation position, which is seen from the vehicle inner side.
Figure 29:
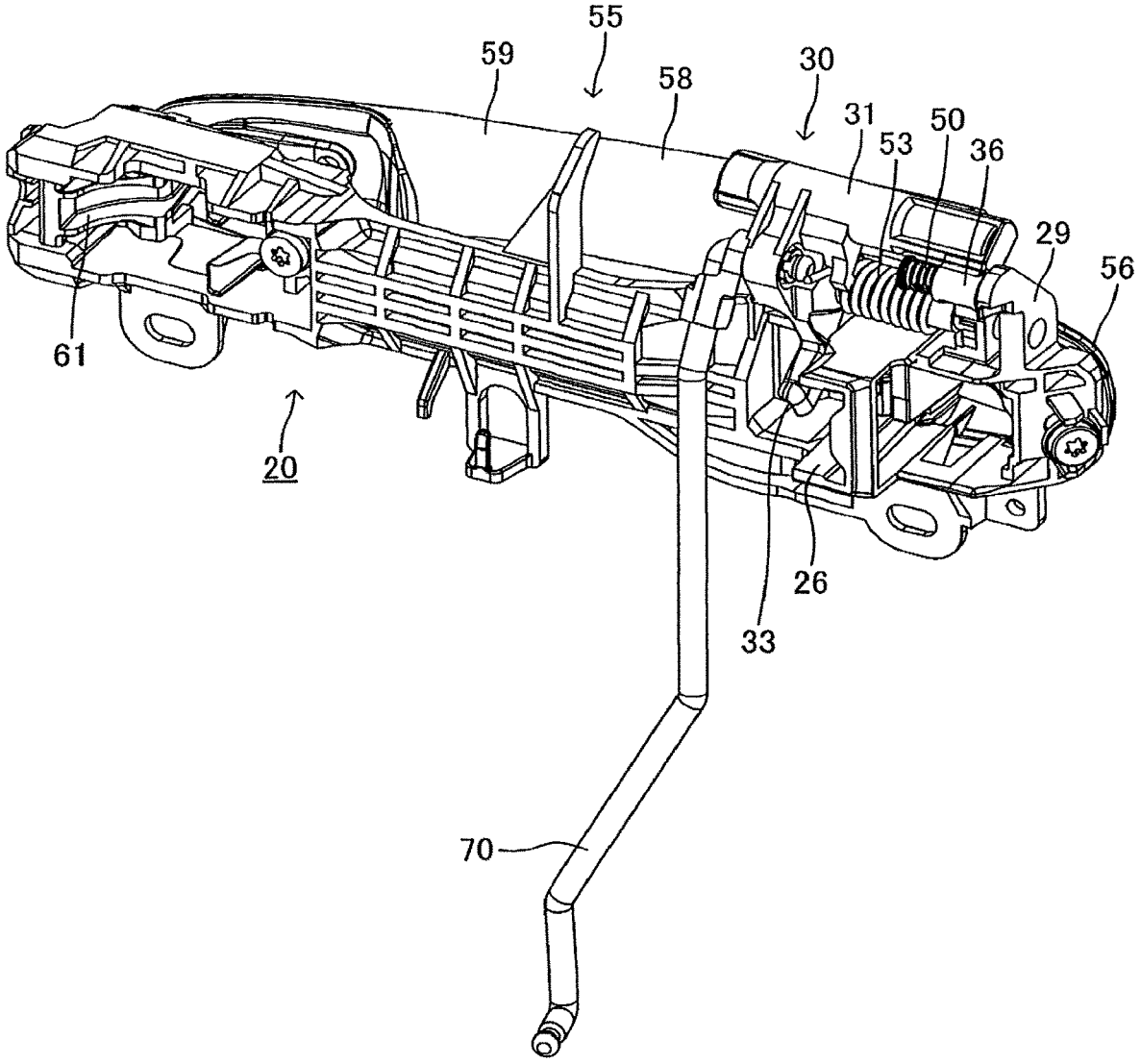
FIG. 29 is a perspective view of the handle apparatus when the bell crank which was positioned at the second operation position has been rotated to a second initial position by placing the outside handle at a first initial position, which is seen from the vehicle inner side.

The support member 21 made of hard resin or rigid resin is an integrally molded member that is extended in the front and rear direction as illustrated in FIGS. 2 to 5, 23, 28 and 29. As illustrated in FIGS. 2 to 4, the support member 21 includes an adjacent space portion 22 formed in a recessed manner manner in the vicinity of a rear end of the support member 21 so as to penetrate the support member 21 in a vehicle width direction (a vehicle inside-outside direction). An opening portion 23 is provided in the vicinity of a rear end of each of an upper surface and a bottom surface of the support member 21. The opening portions 23 provided at the upper side and the lower side, respectively, are connected to (in communication with) a rear end portion of the adjacent space portion 22. Each of the opening portions 23 at the upper side and the lower side is continued to (in communication with) a rear end portion of the adjacent space portion 22. Further, a press piece 24 is provided in the vicinity of the rear end of each of the upper surface and the bottom surface of the support member 21 so as to be positioned inside the respective opening portions 23. Each of the press pieces 24 includes a cantilever structure. A shaft press tab 25 is provided at a distal end portion of each of the press pieces 24 at the upper surface and the lower surface so as to protrude towards the vehicle outer side. An arm through hole 26 is provided at a front portion of the support member 21 so as to penetrate the support member 21 in the vehicle width direction. As illustrated in, for example, FIG. 4, bearing portions 27, 27 are provided at the front portion of the vehicle inner-side surface of the support member 21 to be positioned at an upper side relative to the arm through hole 26. The bearing portions 27, 27 are formed as a pair arranged in the front and rear direction. Each of the bearing portions 27, 27 which are provided at the front and the rear includes a bearing hole 28 of which an axis line is extended in the front and rear direction. A part of a vehicle inner-side surface of each of the bearing holes 28 at the front and rear is open. Further, a rear end surface of the bearing hole 28 at the front and a front end surface of the bearing hole 28 at the rear are open. As illustrated in FIGS. 4 and 28, an upper end surface of each of the bearing portions 27, 27 of the support member 21, which are provided at the front and the rear as a pair, is a temporary stopper surface 27*a* including an inclined surface. As illustrated in FIGS. 2 to 5, 28 and 29, a temporary hold protruding portion 29 is provided in the vicinity of a front end of the support member 21. The temporary hold protruding portion 29 is a wall portion positioned forward relative to the bearing portion 27 at the front. An engaging portion 29*a* is provided at a vehicle inner-side end portion in the vicinity of an upper end of the temporary hold protruding portion 29, so as to protrude downward. The engaging portion 29*a* is formed to be thinner than peripheral portion thereof.

The bell crank unit 30 is attached to the bearing portions 27, 27 (bearing holes 28, 28), which are provided respectively at the front and the rear, of the support member 21 so as to be removable therefrom. For example, as illustrated in FIGS. 6 to 22, the bell crank unit 30 includes a bell crank 31, a temporary hold member 40 and a compression coil spring 50 (i.e., a biasing member).

The bell crank 31 includes a rotation center shaft 32 extended in the front and rear direction. A held portion 32*a*, of which a cross section is noncircular, is provided at each of a front end portion and a rear end portion of the rotation center shaft 32 (refer to FIGS. 6, 8, 9, 12, 13 and 14). A portion of the rotation center shaft 32, the portion except for the held portions 32*a* at the front and rear, is formed of a shaft main body 32*b* of which a cross section is circular. An input arm 33 is provided at a lower end portion of the bell crank 31. The input arm 33 is extended from the rotation center shaft 32 towards the vehicle inner side and is substantially orthogonal to the rotation center shaft 32. A distal end portion (an end portion at the vehicle inner side) of the input arm 33 is formed of a pressed portion 33*a*. A rod connection hole 34 is provided at a central portion in the upper and lower direction of the bell crank 31. A counter weight 35 is provided at an upper end portion of the bell crank 31. A support portion 36 is provided at a bottom surface of a front end portion of the counter weight 35. The support portion 36 is a cylindrical body of which an axis line is extended in the front and rear direction. An inside space portion of the support portion 36 is formed of a support hole 37. As illustrated in FIGS. 7 and 10 to 14, a cross-sectional shape of the support hole 37 is noncircular. A stopper hole 38 including a substantially rectangular shape and being in communication with the support hole 37 is provided at a bottom surface of the support portion 36. A stopper surface 39 is provided at a rear end surface of the stopper hole 38 (refer to FIGS. 7 and 14).

As illustrated in, for example, FIGS. 6 to 22, the temporary hold member 40 integrally includes a flange portion 41 and a main body 42 extended forward from the flange portion 41. A portion of the main body 42, the portion except for an end portion at a side of the flange portion 41, is an insertion portion 43 of which a cross section is noncircular. The cross-sectional shape of the insertion portion 43 is substantially same as the cross-sectional shape of the support hole 37 of the support portion 36. That is, part of an outer circumferential surface of the insertion portion 43 is formed of a flat surface 43*a*. A biasing member attachment portion 44 is provided at an outer circumferential surface of an end portion, at a side of the flange portion 41, of the main body portion 42. The biasing member attachment portion 44 is an annular surface including a circular cross section. A stopper accommodation hole 45 is provided at the insertion portion 43. The stopper accommodation hole 45 penetrates the insertion portion 43 in a radial direction and a plane shape of the stopper accommodation hole 45 includes a substantially rectangular shape. A stopper 46 is provided to extend forward from a rear end surface of the stopper accommodation hole 45. That is, the stopper 46 includes a cantilever structure. A front end of the stopper 46 is positioned rearward relative to a front end surface of the stopper accommodation hole 45. A tab portion 47 is provided at the front end of the stopper 46 so as to extend downwardly. As illustrated in, for example, FIGS. 8, 9, 18 and 19, a rear surface of the tab portion 47 is a lock surface 47*a* which is orthogonal to the front and rear direction, and a front surface of the tab portion 47 is an inclined surface 47*b* which is inclined relative to the front and rear direction and the upper and lower direction. As illustrated in FIGS. 12 and 16 to 19, a lower end of the tab portion 47 is positioned slightly at an inner circumferential side relative to the biasing member attachment portion 44 and at an outer circumferential side (lower side) relative to the flat surface 43*a*, when the stopper 46 is in a free state. An engagement portion 48 corresponding to a recessed groove is provided at an upper surface of a front end portion of the main body portion 42.

An axis line of the compression coil spring 50 made of metal is extended in the front and rear direction. An inner diameter of the compression coil spring 50 is slightly larger than a diameter of the biasing member attachment portion 44 of the temporary hold portion 40 and is smaller than an outer diameter of the flange portion 41 of the temporary hold portion 40.

The bell crank 31, the temporary hold member 40 and the compression coil spring 50 are integrated with one another. To integrate the bell crank 31, the temporary hold member 40 and the compression coil spring 50 with one another, first, the main body portion 42 of the temporary hold member 40 is inserted into an inner space portion of the compression coil spring 50 from the rear side and the compression coil spring 50 is placed at an outer circumferential side of the biasing member attachment portion 44. As described above, the lower end of the tab portion 47 is positioned slightly at the inner circumferential side relative to the biasing member attachment portion 44 when the stopper 46 is in the free state, and the inner diameter of the compression coil spring 50 is larger than the diameter of the biasing member attachment portion 44. Accordingly, it is not highly likely that the tab portion 47 of the temporary hold portion 40 and the compression coil spring 50 interfere with each other when the main body portion 42 of the temporary hold member 40 is being inserted into the inner space portion of the compression coil spring 50. Thus, the temporary hold member 40 and the compression coil spring 50 can be assembled on each other easily.

Figure 8:
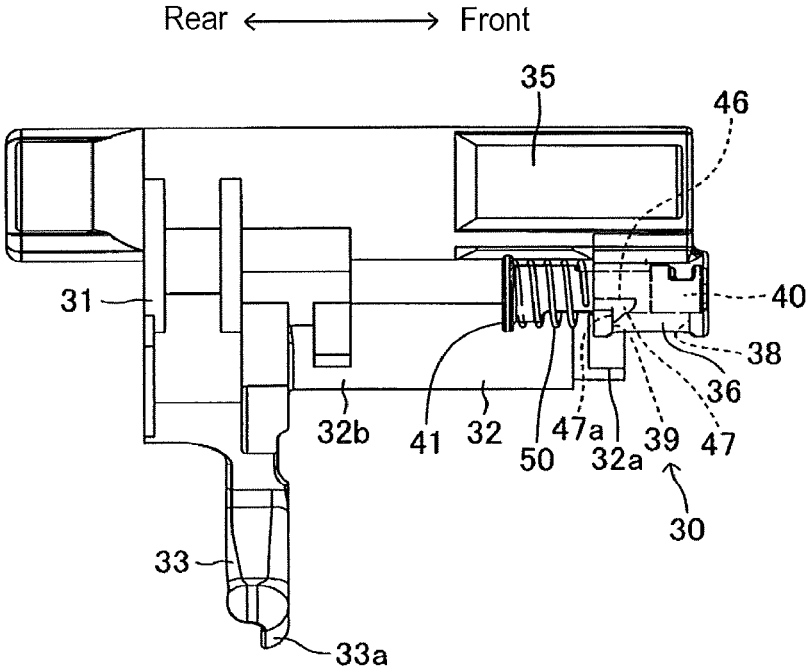
FIG. 8 is a side view of the bell crank unit when a temporary hold member is at a no-hold position, which is seen from the vehicle inner side.
Figure 9:
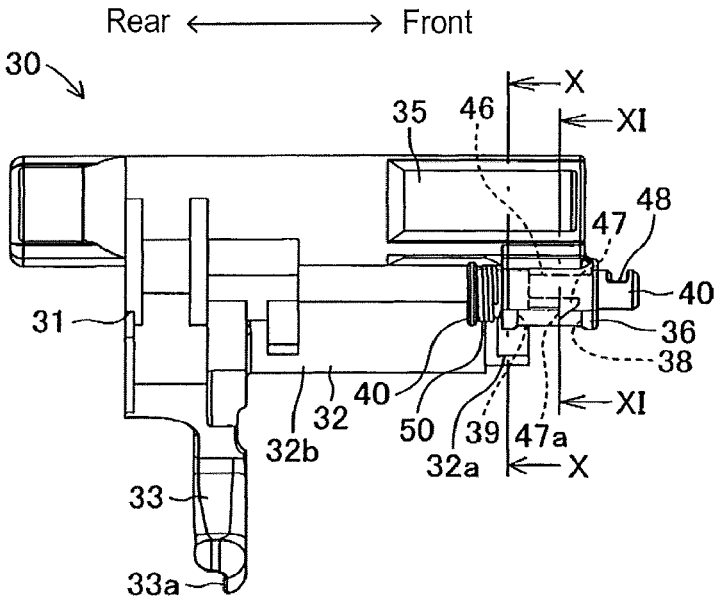
FIG. 9 is a side view of the bell crank unit when the temporary hold member is at a temporary hold position, which is seen from the vehicle inner side.
Figure 10:
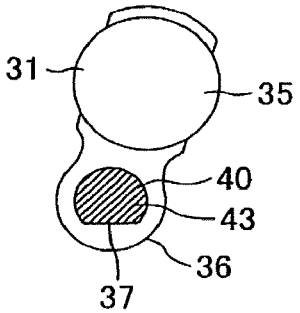
FIG. 10 is a cross-sectional view taken along line X-X in FIG. 9.
Figure 11:
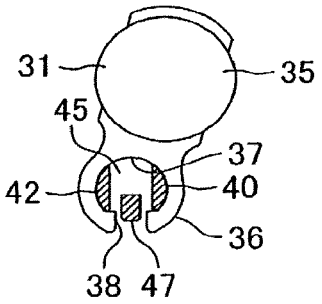
FIG. 11 is a cross-sectional view taken along line XI-XI in FIG. 9.
Figure 12:
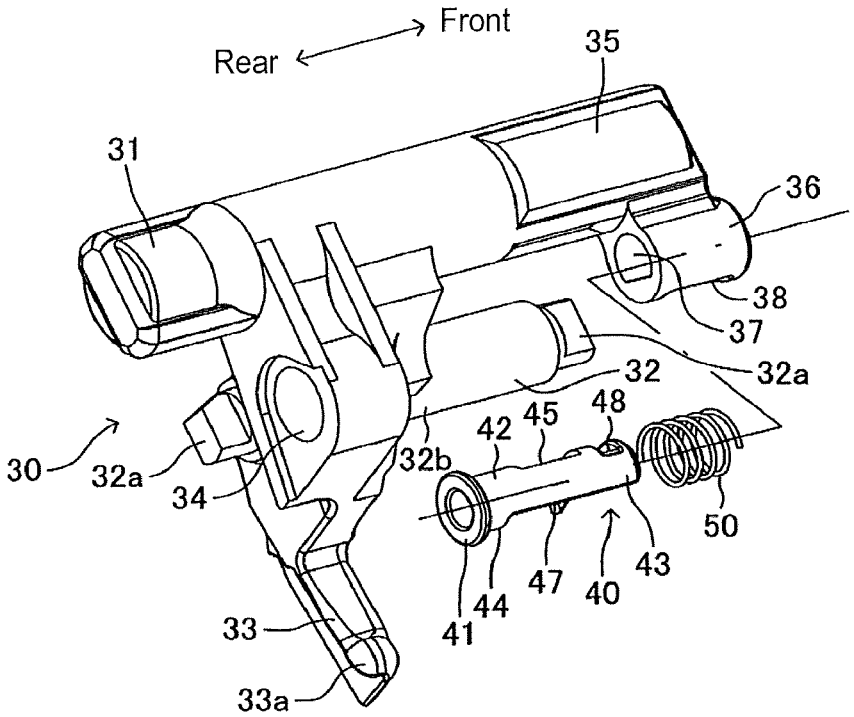
FIG. 12 is a perspective view of a separated state of a bell crank, the temporary hold member and a compression coil spring, which is seen from the vehicle inner side.
Figure 13:
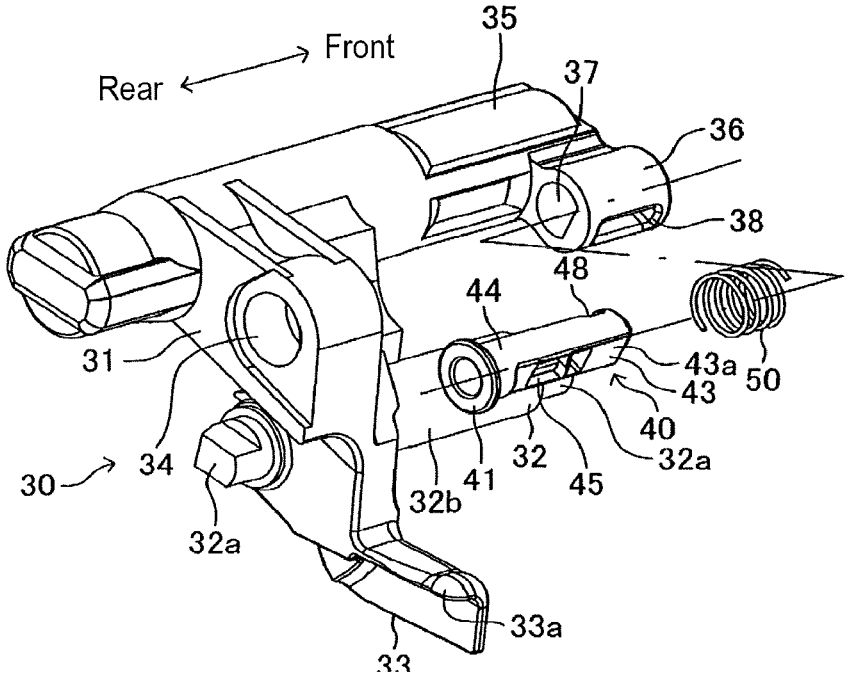
FIG. 13 is a perspective view of the separated state of the bell crank, the temporary hold member and the compression coil spring, which is seen from the vehicle inner side in a direction which is different from FIG. 12.
Figure 14:
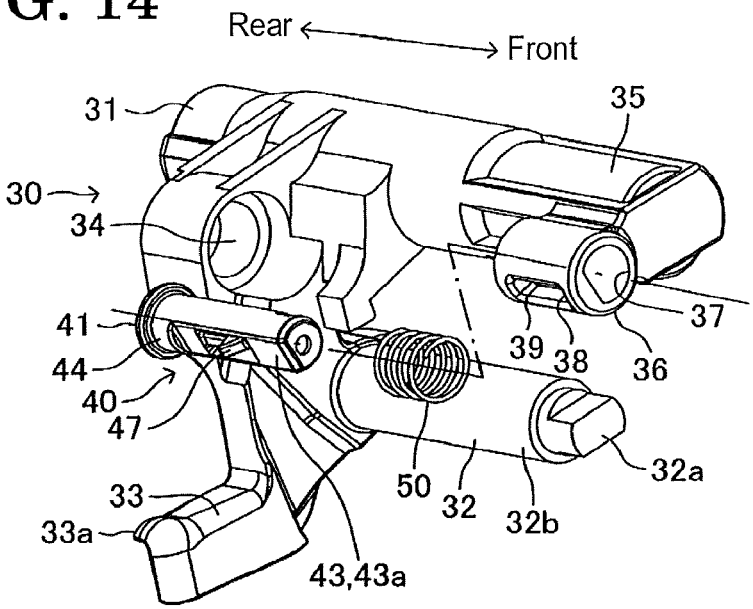
FIG. 14 is a perspective view of the separated state of the bell crank, the temporary hold member and the compression coil spring, which is seen from the vehicle inner side in a direction which is different from FIGS. 12 and 13.
Figure 15:
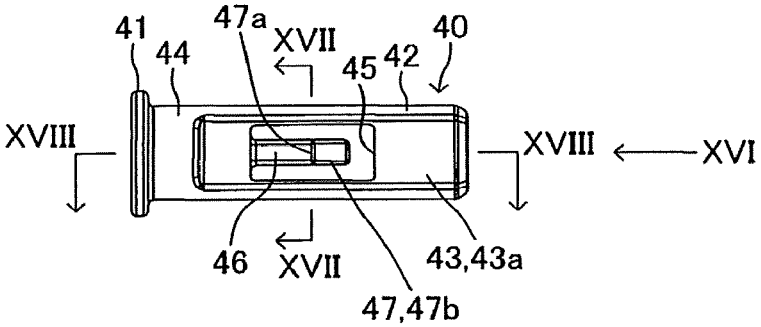
FIG. 15 is a side view of the temporary hold member.
Figure 16:
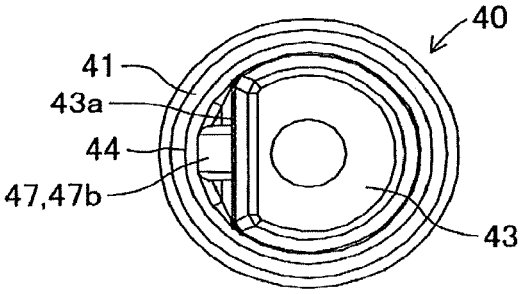
FIG. 16 is a front view of the temporary hold member seen from a direction of line XVI in FIG. 15.
Figure 17:
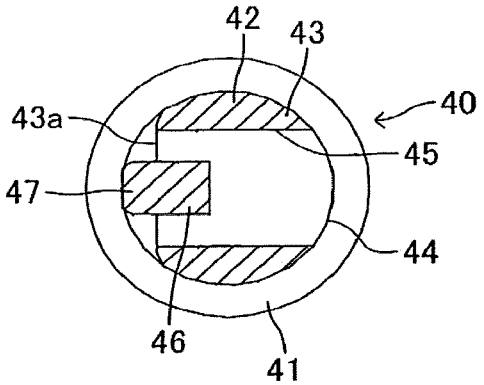
FIG. 17 is a cross-sectional view taken along line XVII-XVII in FIG. 15.
Figure 18:
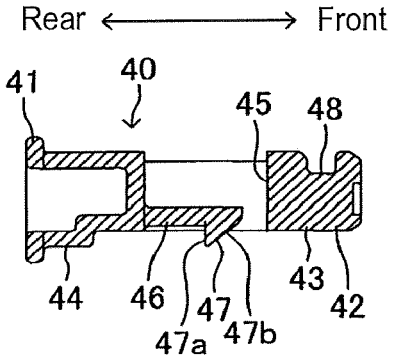
FIG. 18 is a cross-sectional view taken along line XVIII-XVIII in FIG. 15.
Figure 19:
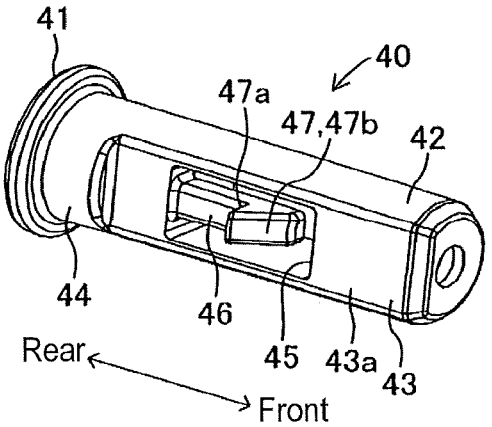
FIG. 19 is a perspective view of the temporary hold member.
Figure 20:
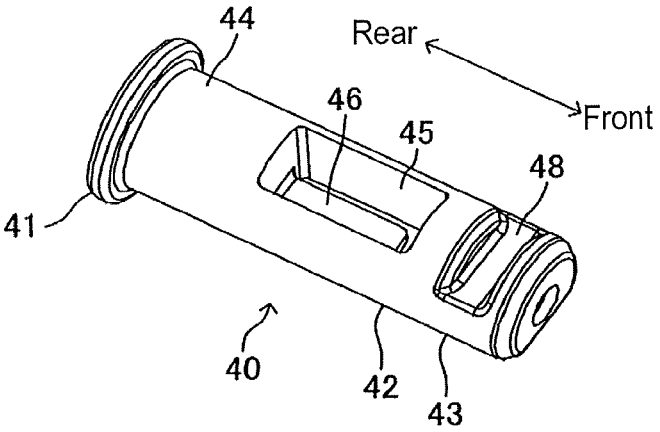
FIG. 20 is a perspective view of the temporary hold member seen from a direction which is different from FIG. 19.
Figure 21:
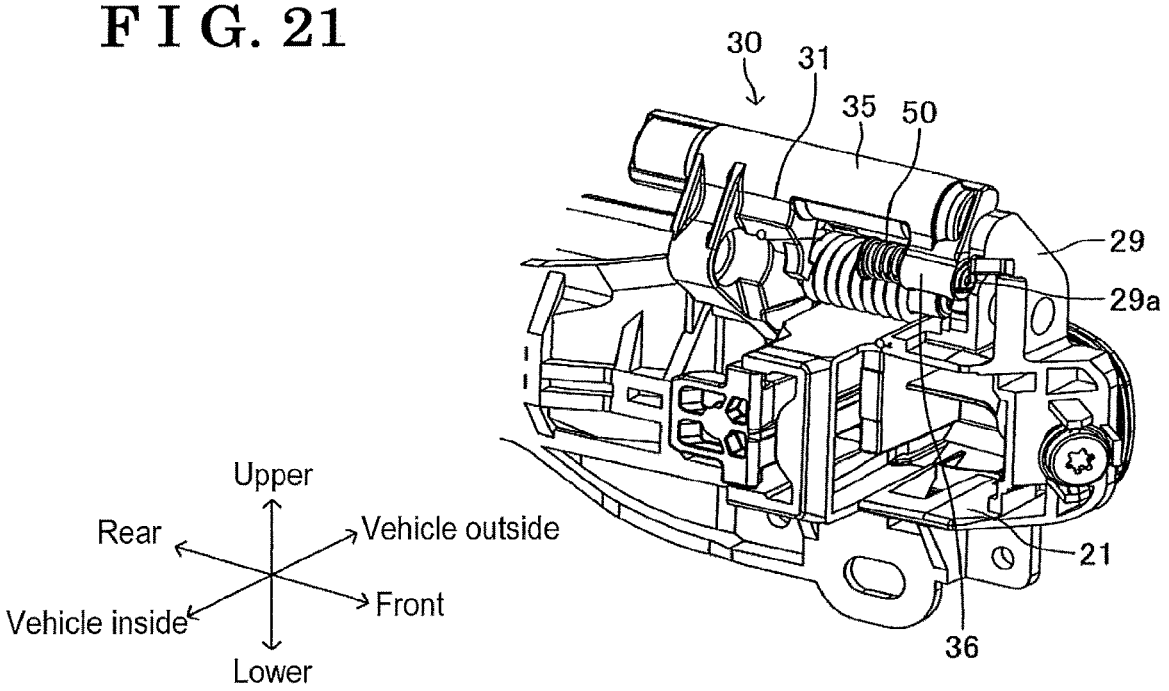
FIG. 21 is a perspective view of a front portion of a handle apparatus when the temporary hold member is positioned at the no-hold position and the bell crank is positioned at an assembly position, which is seen from the vehicle inner side.

Subsequently, the insertion portion 43 of the temporary hold member 40 that has been integrated with the compression coil spring 50 is inserted, from the rear side, into the support hole 37 of the support portion 36 of the bell crank 31. As described above, the lower end of the tab portion 47 is positioned at the outer circumferential side (lower side) relative to the flat surface 43*a* when the stopper 46 is in the free state. Accordingly, when the insertion portion 43 is being inserted into the support hole 37, the inclined surface 47*b* of the tab portion 47 comes in contact with a lower edge portion of a rear end portion of the support hole 37 and the stopper 46 becomes elastically deformed upwardly until the entire tab portion 47 is positioned inside the stopper accommodation hole 45. Thus, the tab portion 47 moves to the inside of the support hole 37. When the insertion portion 43 has been inserted into the support hole 37 by a certain amount of insertion, the tab portion 47 comes to face the stopper hole 38 of the support portion 36 of the bell crank 31 in a radial direction of the support hole 37. Then, the stopper 46 returns to be in the free state as illustrated in FIG. 11, and thus the tab portion 47 is positioned in the stopper hole 38. Further, the lock surface 47*a* of the tab portion 47 comes to face the stopper surface 39 of the stopper hole 38 in the front and rear direction as illustrated in FIGS. 8 and 9. When the tab portion 47 comes to be positioned in the stopper hole 38, the integration operation of the bell crank 31, the temporary hold member 40 and the compression coil spring 50 with one another is completed. In other words, the bell crank unit 30 formed of the bell crank 31, the temporary hold member 40 and the compression coil spring 50 is completed. The insertion portion 43 of the temporary hold member 40 is slidable in the front and rear direction relative to the support hole 37 of the support portion 36. Further, the respective cross-sectional shapes of the insertion portion 43 and the support hole 37 are noncircular shapes that are substantially identical to each other. Consequently, the temporary hold member 40 is restricted from rotating relative to the support portion 36.

Figure 6:
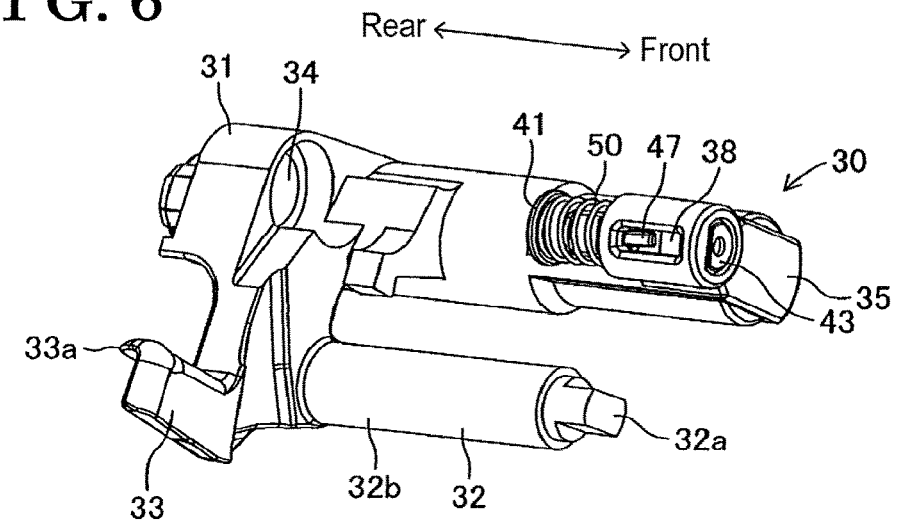
FIG. 6 is a perspective view of the bell crank unit seen from the vehicle inner side.
Figure 7:
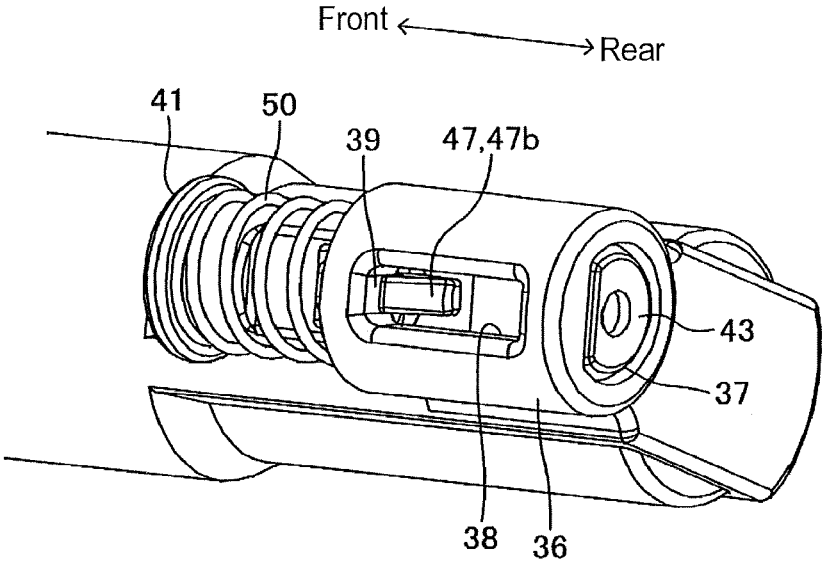
FIG. 7 is an enlarged perspective view of a front portion of the bell crank unit seen from the vehicle inner side.

Once the bell crank unit 30 is completed, the compression coil spring 50 is elastically deformed between a rear end surface of the support portion 36 and the flange portion 41 of the temporary hold member 40. In other words, the compression coil spring 50 becomes compressed from a free state, that is, compressed relative to the free state. Accordingly, the compression coil spring 50 exerts a biasing force which moves the temporary hold member 40 rearward relative to the support portion 36. The rearward movement of the temporary member 40 relative to the support 36 is restricted when the lock surface 47*a* of the tab portion 47 is in contact with the stopper surface 39 of the stopper hole 38 as illustrated in FIGS. 6 to 8. A position of the temporary hold member 40 at this time is a no-hold position (i.e., a first position). As described above, the temporary hold member 40 positioned at the no-hold position is restricted from moving rearward relative to the bell crank 31 (support portion 36), while the bell crank unit 30 includes the simple configuration. On the other hand, when an external force in the forward direction which is larger than the biasing force of the compression coil spring 50 is applied to the temporary hold member 40, the lock surface 47*a* of the tab portion 47 is disengaged and separated from the stopper surface 39 of the stopper hole 38 towards a front side, and thus the temporary hold member 40 moves forward relative to the support portion 36. As a result, the temporary hold member 40 comes to be positioned at a temporary hold position (i.e., a second position) (refer to FIGS. 9, 22 and 23). When the above-mentioned external force is eliminated when the temporary hold member 40 is positioned at the temporary hold position, the temporary hold member 40 automatically returns to the no-hold position due to the biasing force of the compression coil spring 50.

Figure 22:
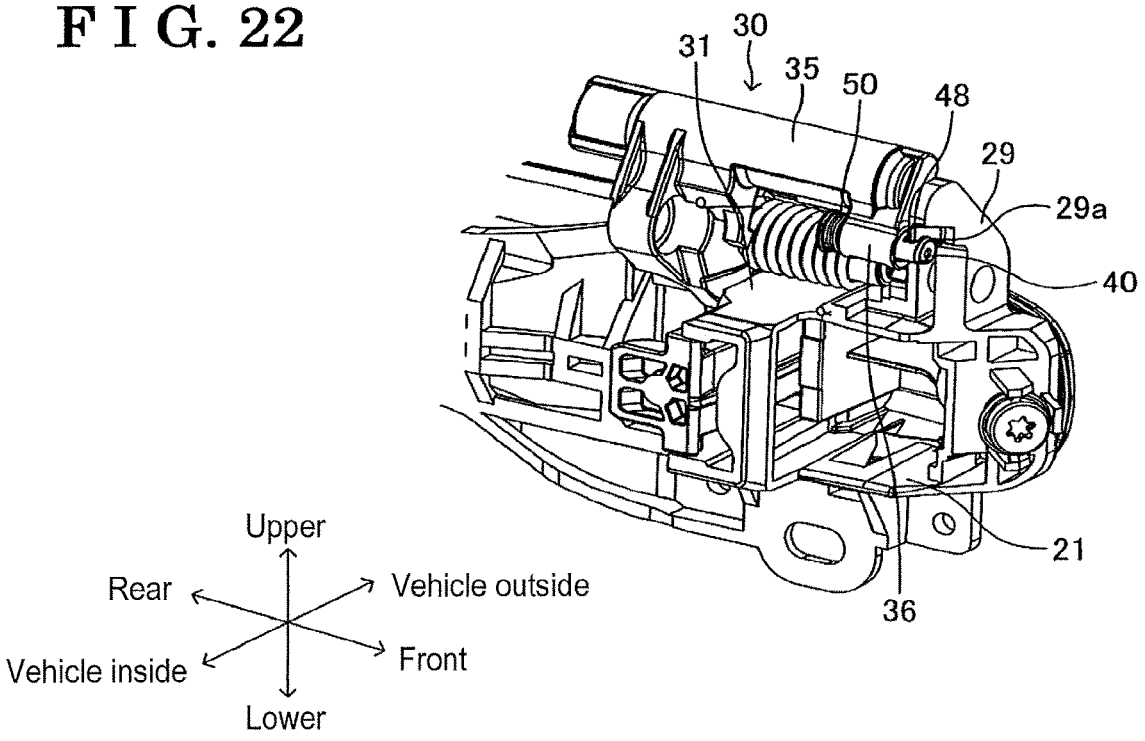
FIG. 22 is a perspective view of the front portion of the handle apparatus when the temporary hold member is positioned at the temporary hold position and the bell crank is positioned at the assembly position, which is seen from the vehicle inner side.
Figure 23:
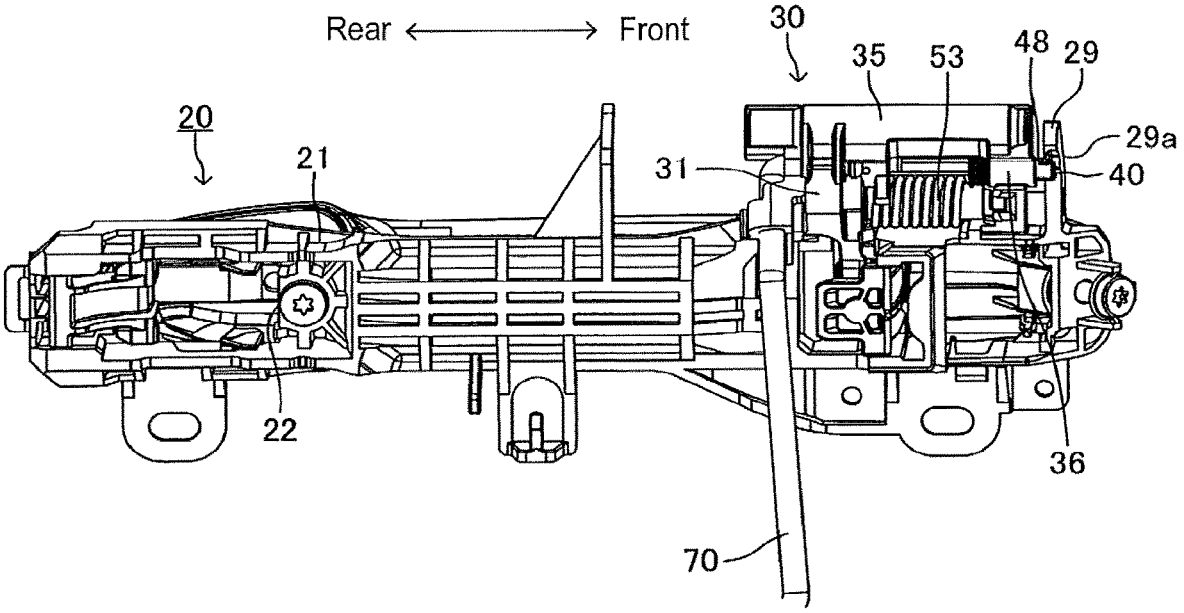
FIG. 23 is a side view of the handle apparatus when the temporary hold member is positioned at the temporary hold position and the bell crank is positioned at the assembly position, which is seen from the vehicle inner side.
Figure 24:
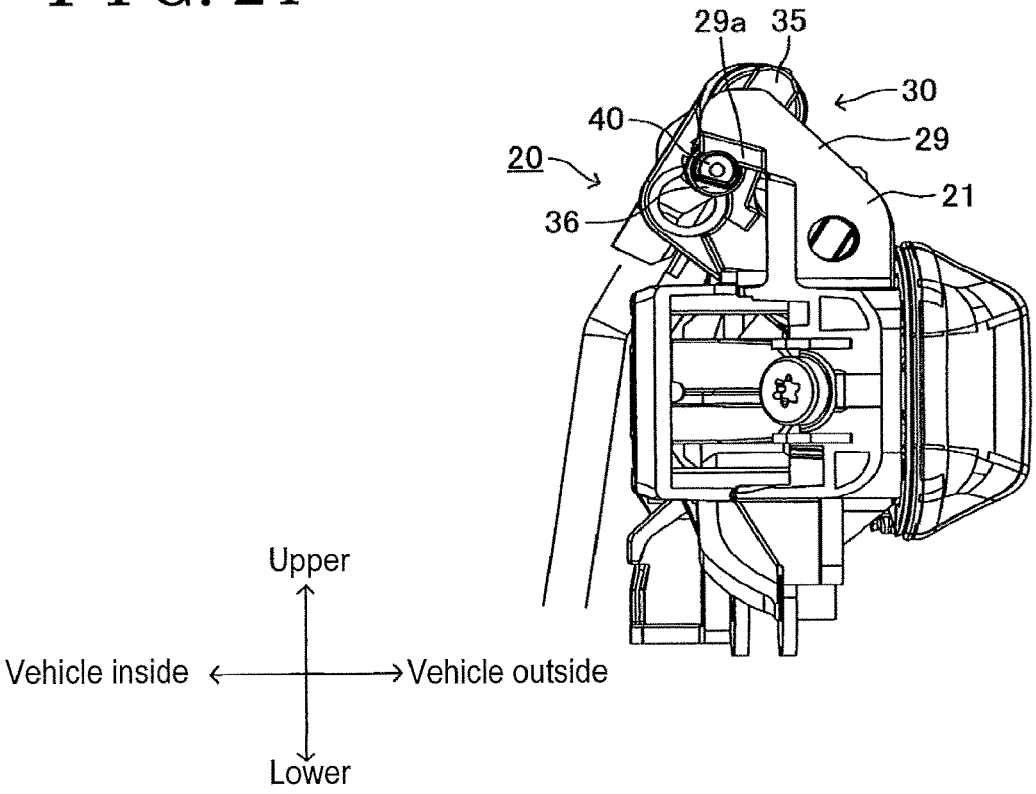
FIG. 24 is a front view of the handle apparatus illustrated in FIG. 23.

A torsion coil spring 53, which is illustrated in for example FIGS. 4, 12 to 14 and 23, is attached to the rotation center shaft 32 of the bell crank 31 of the integrated bell crank unit 30. As illustrated in FIGS. 22 to 24, in a state where the input arm 33 is positioned in the arm through hole 26 of the support member 21, the held portions 32*a*, which are at the front and rear sides, of the rotation center shaft 32 integrated with the torsion coil spring 53 are inserted into the respective bearing holes 28 of the bearing portions 27, at the front and rear sides, of the support member 21 from the vehicle inner side. When the held portions 32*a*, at the front and rear sides, of the rotation center shaft 32 are being inserted into the corresponding bearing holes 28, at least one members of the held portions 32*a* and the bearing portions 27 become elastically deformed, and the elastically deformed members return to the free state when the insertion operation is completed. Thus, the bell crank unit 30 is rotatable about the rotation center shaft 32 relative to the bearing holes 28 (bearing portions 27).

Once the rotation center shaft 32 has been placed by insertion in the bearing holes 28, the held portions 32*a* at the front and rear sides do not come off or fall off from the respective bearing holes 28 towards the vehicle inner side unless the held portions 32*a* are moved towards the vehicle inner side intentionally with a strong force. Further, a movement of the bell crank 31 in the front and rear direction relative to the support member 21 (the bearing portions 27 at the front and the rear) is restricted to a minute or very small range. More specifically, the movement of the bell crank 31 in the forward direction relative to the support member 21 is restricted at a position at which a front end surface of the shaft main body 32*b* is in contact with a rear surface of the bearing portion 27 which is arranged at the front side, and the movement of the bell crank 31 in the rear direction relative to the support member 21 is restricted at a position at which a rear end surface of the shaft main body 32*b* is in contact with a front surface of the bearing portion 27 which is arranged at the rear side. That is, the movement of the bell crank 31 in the front and rear direction relative to the support member 21 is allowed only in a range including a sum of dimensions resulting from adding a minute clearance between the front end surface of the shaft main body 32*b* and the rear surface of the bearing portion 27 at the front side, and a minute clearance between the rear end surface of the shaft main body 32*b* and the front surface of the bearing portion 27 at the rear side, to each other.

In a state where the torsion coil spring 53 is elastically deformed, one of lock portions provided at respective both end portions of the torsion coil spring 53 is locked at the bell crank 31 and the other of the lock portions, which are provided as a pair, is locked at the support member 21. Thus, when any other external forces in the rotational direction other than a rotational biasing force generated by the torsion coil spring 53 are not exerted on the bell crank 31, the bell crank unit 30 is rotationally biased in the clockwise direction in FIG. 24 by the rotational biasing force of the torsion coil spring 53.

Thus, when no other external force in the rotational direction other than the rotational biasing force of the torsion coil spring 53 is exerted on the bell crank 31 in a state where the temporary hold member 40 is positioned at the no-hold position, the counter weight 35 of the bell crank 31 is in contact with the front and rear temporary stopper surfaces 27*a* of the bearing portions 27, and accordingly the bell crank 31 is restricted from rotating (in the clockwise direction in FIG. 24). A rotational direction position of the bell crank 31 (bell crank unit 30) at this time is a temporary initial position.

When an external force which is larger than the rotational biasing force of the torsion coil spring 53 and is in a direction opposite to the rotational biasing force of the torsion coil spring 53 is applied or exerted on the bell crank 31 when the bell crank 31 is positioned in the temporary initial position, the bell crank 31 rotates in the counter clock direction in FIG. 24. When the bell crank 31 is rotated until the temporary hold member 40 comes to be positioned at the vehicle inner side relative to the position illustrated in FIG.

21, a front surface of the temporary hold member 40 does not face the temporary hold protruding portion 29 in the front and rear direction any more. In this state, when the operator moves the temporary hold member 40 to the temporary hold position against the biasing force of the compression coil spring 50 with, for example, his or her hand, positions in the front and rear direction of a front end portion of the temporary hold member 40 and the temporary hold protruding portion 29 (engaging portion 29*a*) coincide with each other. Then, when the above-described external force that has been exerted on the bell crank 31 while the temporary hold member 40 being maintained at temporary hold position is eliminated, the bell crank 31 is rotated in the clock wise direction in FIG. 24 by the rotational biasing force of the torsion coil spring 53. As a result, as illustrated in FIGS. 22, 23 and 24, the engagement portion 48 of the temporary hold member 40 engages with the engaging portion 29*a* of the temporary hold protruding portion 29 of the support member 21 from the vehicle inner side. Thus, due to the engaging portion 29*a* and the engagement portion 48, a relative rotational position of the bell crank unit 30 (bell crank 31) relative to the support member 21 is temporarily maintained at an assembly position illustrated in FIGS. 22, 23 and 24.

In a state where the relative rotational position of the bell crank unit 30 (bell crank 31) relative to the support member 21 is temporarily held at the assembly position, the bell crank unit 30 and the support member 21 are fixed to a vehicle inner-side surface of the outer panel 12 such that a vehicle outer-side surface of the support member 21 faces the assembly through holes 12*a* and 12*b*.

As illustrated in FIGS. 2 to 5, 28 and 29, the outside handle 55 includes a fixing portion 56 and a handle main body 58 which are separated from each other.

The fixing portion 56 forms a front end portion of the outside handle 55. A vehicle outer-side surface of the fixing portion 56 is formed of a curved surface. A vehicle inner-side surface of the fixing portion 56 is fixed to the vehicle outer-side surface of the outer panel 12.

The handle main body 58 includes a grip portion 59, a rear insertion portion 61, a rotary shaft 62 and a pressing arm 64 in an integrated manner with one another. The grip portion 59 is extended in a substantially front and rear direction and a plane shape of the grip portion 59 is a substantially U-shape. A vehicle outer-side surface of the grip portion 59 is a curved surface. As illustrated in FIGS. 2, 3, 5, 25 and 26, a grip protruding portion 60 is provided in the vicinity of a front end of a vehicle inner-side surface of the grip portion 59 so as to protrude towards the vehicle inner side. When an occupant positioned outside the vehicle holds and grips the grip 59 with his or her hand, the occupant places and hooks his finger(s) onto the grip protruding portion 60. In other words, the grip protruding portion 60 is a portion helping the occupant to grip the grip portion 59 with his hand easily. The rear insertion portion 61 extended towards the vehicle inner side is provided at a rear end portion of the handle main body 58. The rotary shaft 62 including a columnar shape of which an axis line extends in the upper and lower direction is fixed to a rear end portion of the rear insertion portion 61. An upper end portion of the rotary shaft 62 is positioned at an upper side relative to the rear insertion portion 61 and a lower end portion of the rotary shaft 62 is positioned at a lower side relative to the rear insertion portion 61. The pressing arm 64 extended towards the vehicle inner side is provided at a front end portion of the handle main body 58. Further, a pressing portion 65 extended towards the rear side is provided at a distal end portion (a vehicle inner-side end portion) of the pressing arm 64.

The handle 58 is attached to the support member 21 from the vehicle outer-side of the outer panel 12 after the support member 21, which has been integrated with the bell crank unit 30 temporarily held at the assembly position, is fixed to the outer panel 12.

Figure 25:
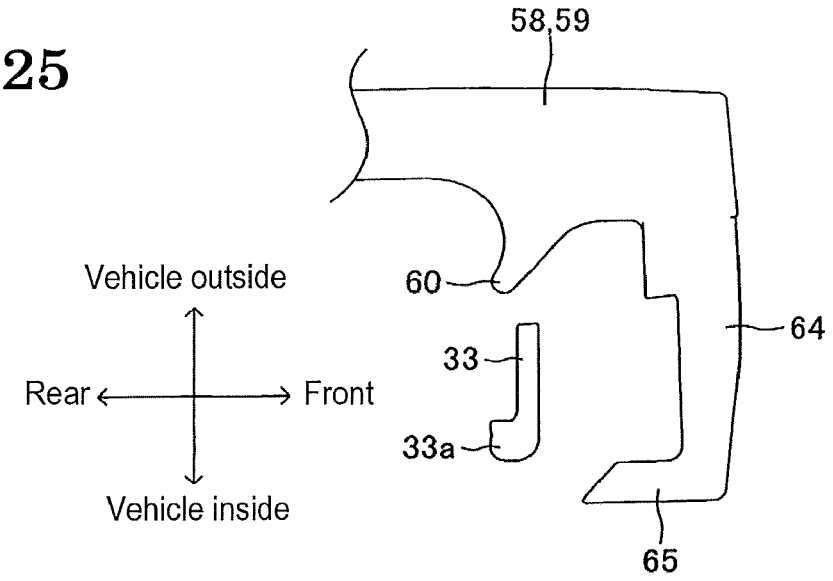
FIG. 25 is a schematic plane view when the outside handle is being attached to the support member in a state where the bell crank is positioned at the assembly position.

When attaching the handle main body 58 to the support member 21, first, the rear insertion portion 61 of the handle main body 58 is made to pass through the assembly through hole 12*a* and be positioned at the vehicle inner side of the outer panel 12, and the pressing arm 64 is made to pass through the assembly through hole 12*b* and be positioned at the vehicle inner side of the outer panel 12. Further, the rear insertion portion 61 and the rotary shaft 62 are placed by insertion in the adjacent space portion 22 of the support member 21. Further, as illustrated in FIG. 25, the pressing arm 64 is inserted into the arm through hole 26 of the support member 21. Then, inside the arm through hole 26, the pressing arm 64 is placed immediately in front of the input arm 33.

Figure 26:
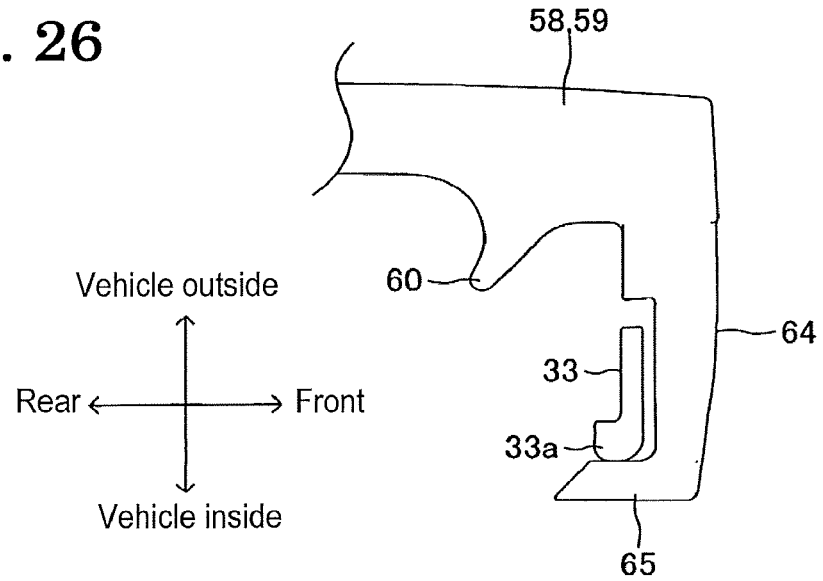
FIG. 26 is a schematic plane view when the attachment operation of the outside handle to the support member is completed by moving the outside handle rearward from the position illustrated in FIG. 25.

Subsequently, the pressing arm 64 is moved further towards the vehicle inner side relative to the support member 21 (outer panel 12), while the rear insertion portion 61 and the rotary shaft 62 being positioned in the adjacent space portion 22 of the support member 21. Thus, as illustrated in FIG. 25, the pressing portion 65 comes to be positioned at the vehicle inner side relative to the pressed portion 33*a* of the input arm 33. When the bell crank unit 30 and the handle main body 58 are in the above-described positional relation, the handle main body 58 can be moved towards the rear side relative to the support member 21 such that the rotary shaft 62 positioned in the adjacent space portion 22 moves towards the press piece 24 (towards the rear side). In other words, the rotary shaft 62 of the handle main body 58 can be moved rearward without the pressing portion 65 of the handle main body 58 interfering with the input arm 33 of the bell crank 31. When the handle main body 58 has moved rearward, the upper and lower end portions of the rotary shaft 62 of the handle main body 58 come to be positioned inside the respective opening portions 23, which are positioned at the upper side and the lower side, of the support member 21. Then, the upper end portion of the rotary shaft 62 comes to be positioned between an inner surface (vehicle inner-side surface) of the opening portion 23 at the upper side and the corresponding press piece 24, and the lower end portion of the rotary shaft 62 comes to be positioned between an inner surface (vehicle inner-side surface) of the opening portion 23 at the lower side and the corresponding press piece 24. At this time, the press pieces 24 at the upper and lower sides hold the rotary shaft 62 between the press pieces 24 and the inner surfaces of the respective opening portions 23 in a sandwiching manner while the press pieces 24 are elastically deformed towards the vehicle outer side, and the shaft press tabs 25 of the press pieces 24 at the upper and lower sides come in contact with the respective upper and lower end portions of the rotary shaft 62 from the front side. Accordingly, the rotary shaft 62 of the handle main body 58 is rotatably supported by the inner surfaces of the opening portions 23 at the upper and lower side, and by the press pieces 24 (shaft press tabs 25) at the upper and lower sides. Further, as illustrated in FIG. 26, the pressing portion 65 of the pressing arm 64 is in contact with the pressed portion 33*a* of the input arm 33 from the vehicle inner side.

Figure 27:
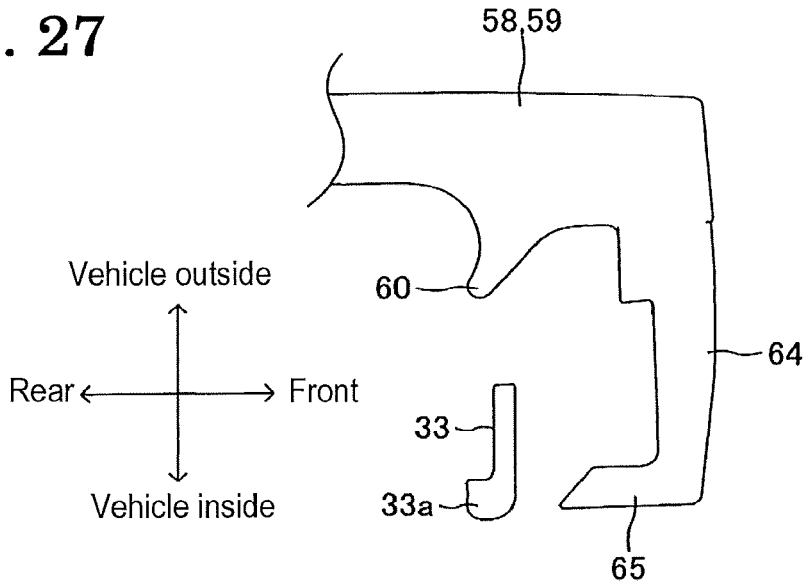
FIG. 27 is a schematic plane view of a comparative example, which is similar to FIG. 25.

If the bell crank 31 (bell crank unit 30) is presumed to be at the temporary initial position, the input arm 33 is positioned at the vehicle inner side relative to when the bell crank 31 is positioned at the assembly position as illustrated in FIG. 27. Accordingly, if the handle main body 58 is moved rearward relative to the support member 21 in this state, the pressing portion 65 of the pressing arm 64 interferes with the input arm 33 from the front side. That is, the handle main body 58 cannot be moved rearward relative to the support member 21 such that the rotary shaft 62 of the handle main body 58 is rotatably supported by the inner surfaces of the opening portions 23 at the upper and lower side and by the press pieces 24 (shaft press tabs 25) at the upper and lower sides. In addition, it is assumed that the handle main body 58 at the position illustrated in FIG. 27 is moved towards the rear side and the vehicle inner side relative to the support member 21 (that is, it is assumed that the handle main body 58 is moved in a direction which is inclined relative to the vehicle width direction and the front and rear direction in a plan view) in order to make the pressing portion 65 of the pressing arm 64 be in contact with the pressed portion 33*a* of the input arm 33 from the vehicle inner side, when the input arm 33 is positioned at the position illustrated in FIG. 27. In this case, however, the grip protruding portion 60 of the handle main body 58 interferes with the vehicle outer-side surface of the support member 21, and thus the pressing portion 65 of the pressing arm 64 cannot be moved towards the vehicle inner side relative to the pressed portion 33*a* of the input arm 33.

When the pressing portion 65 of the pressing arm 64 is in contact with the pressed portion 33*a* of the input arm 33 from the vehicle inside, the bell crank 31 and the outside handle 55 move in an associated manner or linked manner with each other. As illustrated in FIG. 28, when the operator holds and grips the handle main body 58 with his or her hand and rotates the handle main body 58 up to a first operation position serving as a limit position in the rotation direction towards the vehicle outer side, the bell crank 31 of which the pressed portion 33*a* (input arm 33) is pushed by the pressing portion 65 towards the vehicle outer side rotates from the assembly position to a second operation position (operation position) illustrated in FIG. 28. Accordingly, the engagement portion 48 of the temporary hold member 40 disengages and is separated from the engaging portion 29*a* of the support member 21 towards the vehicle inner side. Then, as illustrated in FIG. 28, the temporary hold member 40 moves to the no-hold position due to the biasing force of the compression coil spring 50.

In this state, when the operator releases his or her hand off the handle main body 58, the bell crank 31 is rotated by the rotational biasing force of the torsion coil spring 53 in the clockwise direction in FIG. 24 and the outside handle 55 rotates in association with the rotation of the bell crank 31. When part of the outside handle 55 is in contact with the vehicle outer-side surface of the support member 21 from the vehicle outer side, the outside handle 55 is restricted from rotating at a first initial position illustrated in FIGS. 5 and 29. At this time, the bell crank 31 is positioned at a second initial position (initial position) illustrated in FIGS. 5 and 29. The second initial position is a position of the bell crank 31 which has slightly rotated from the temporary initial position in the counter clock direction in FIG. 24. That is, when the bell crank 31 is positioned at the second initial position, the bell crank 31 is slightly separated from the temporary stopper surfaces 27*a* towards the vehicle inner side.

An upper end portion (front end portion) of a linkage rod 70 is rotatably connected to the rod connection hole 34 of the bell crank 31 of the handle apparatus 20 that has been mounted on the outer panel 12 in the above-described procedures. The linkage rod 70 is illustrated in FIG. 1 and corresponds to a hard member made of metal. A lower end portion (rear end portion) of the linkage rod 70 is connected to the outside open lever of the lock apparatus 13.

Next, operation of the lock apparatus 13 and the handle apparatus 20 which are attached to the vehicle door 10 will be explained.

As is well known, when the lock knob 14 is positioned at the lock position in a state where the vehicle door 10 closes the opening portion formed at the vehicle body, the lock apparatus 13 is in a latched state where the latch holds or grips a striker fixed to the vehicle body. In this case, when the outside handle 55 is rotated from the first initial position to the first operation position, the bell crank 31 positioned at the second initial position is rotated to the second operation position. Thus, the rotational force of the bell crank 31 is transmitted to the outside open lever of the lock apparatus 13 via the linkage rod 70, and accordingly the outside open lever rotates. In this case, however, the lock apparatus 13 remains in the latched state. To the contrary, in a state where the lock knob 14 is positioned at the unlock position, when the outside handle 55 is rotated from the first initial position to the first operation position, the outside open lever rotates and the rotational force of the outside open lever is transmitted to the latch via the open link and the pawl. As a result, the lock apparatus 13 is brought into an unlatch state in which the latch releases the striker. Consequently, the vehicle door 10 can be rotated in an open direction relative to the vehicle body.

When the outside handle 55 positioned at the first initial position is operated and rotated towards the first operation position and thus the bell crank 31 is rotated towards the second operation position relative to the assembly position, a bell crank operation force F corresponding to a predetermined force may be transmitted from the lock apparatus 13 to the bell crank 31 via the linkage rod 70 as illustrated in FIG. 1. As illustrated in FIG. 1, the bell crank operation force F is a force in a diagonally forward upward direction. Thus, the bell crank operation force F includes a component force in a forward direction, that is, a forward component force. Accordingly, when the forward component force of the bell crank operation force F is transmitted from the linkage rod 70 to the bell crank 31, the bell crank 31 may slide in the forward direction relative to the support member 21. However, as described above, an amount of the relative sliding movement of the bell crank 31 at this time is extremely small. In other words, even if the bell crank 31 slides in the forward direction relative to the support member 21 due to the forward component force of the bell crank operation force F when the temporary hold member 40 is at the no-hold position, the front end of the temporary hold member 40 is positioned at the rear side relative to the temporary hold protruding portion 29 (engaging portion 29*a*). Further, the temporary hold member 40 is supported by the bell crank 31 to be relatively slidable between the non-hold position and the temporary hold position. That is, the forward component force of the bell crank operation force F does not act or operate between the bell crank 31 and the temporary hold member 40. Consequently, the temporary hold member 40 biased by the compression coil spring 50 to move to the non-hold position does not move to the temporary hold position due to the forward component force of the bell crank operation force F transmitted to the bell crank 31.

As described above, when the temporary hold member 40 is positioned at the no-hold position, the positions, in the front and rear direction, of the engagement portion 48 of the temporary hold portion 40 and the engaging portion 29*a* of the support member 21 do not coincide with each other even if the forward component force of the bell crank operation force F is extended to the bell crank 31 during the rotational operation of the outside handle 55. That is, while the outside handle 55 is performing the rotational operation, the engagement portion 48 of the temporary hold portion 40 and the engaging portion 29*a* of the support member 21 do not engage with each other unintentionally, and thus the temporary hold member 40 does not come to be held at the temporary hold position unintentionally. Consequently, when the outside handle 55 is rotated towards the first initial position after the outside handle 55 positioned at the first initial position is rotated to the first operation position, the outside handle 55 rotates and returns to the first initial position reliably and the bell crank 31 rotates and returns to the second initial position reliably.

The disclosure is not limited to the above-described embodiment.

For example, an inside handle (operation member) may be rotatably provided at a trim of the vehicle door 10. The inside handle is linked to an inside open lever via an operation wire, for example. The inside open lever is positioned at an initial position when the inside handle is positioned at an initial position, and the inside open lever does not exert any force on the outside open lever of the lock apparatus 13. The inside open lever does not exert any forces or does not influence the outside open lever of the lock apparatus 13. On the other hand, when the inside handle moves from the initial position to a latch-released position, the inside open lever moves to a latch-released position and causes the outside open lever of the lock apparatus 13 to move to a latch-released position.

This disclosure is applicable to a handle apparatus configured to be provided at a swing-type vehicle door.

An objective of this disclosure is to provide a handle apparatus for a vehicle which can prevent a bell crank from being temporarily held at an assembly position unintentionally when a handle is operated.

According to the aforementioned embodiment, the handle apparatus for a vehicle includes the support member 21 configured to be fixed to the vehicle door 10 including the lock apparatus 13. The apparatus includes the bell crank 31 supported by the support member 21 to be rotatable between the second initial position and the second operation position. In a state where the bell crank 31 is linked to the lock apparatus 13, the bell crank 31 causes the lock apparatus 13 to be in the latched state when the bell crank 31 is in the second initial position and causes the lock apparatus 13 to be in the unlatched state when the bell crank 31 is in the second operation position. The latched state is configured to hold the vehicle door 10 in the closed state and the unlatched state is configured to permit the vehicle door 10 to open. The apparatus includes the handle 55 including the pressing portion 65. In a case where the handle 55 is rotatably attached to the support member 21 in a state where the pressing portion 65 is in contact with the pressed portion 33*a* provided at the bell crank 31, the handle 55 causes, via the pressed portion 33*a* and the pressing portion 65, the bell crank 31 to rotate between the initial position and the operation position when the handle 55 rotates. The apparatus includes the temporary hold member 40 supported by the bell crank 31 in such a manner that the temporary hold member 40 is slidable between the no-hold position (i.e., the first position) and the temporary hold position (i.e., the second position) and that the temporary hold member 40 is biased to move to the no-hold position. The temporary hold member 40 includes the engagement portion 48 configured to engage with and disengage from the engaging portion 29*a* provided at the support member 21 when the temporary hold member 40 is in the temporary hold position.

According to the above-described configuration, only when the temporary hold member 40 is at the temporary hold position and the bell crank 31 is at the predetermined assembly position between the second initial position and the second operation position, the engagement portion 48 of the temporary hold member 40 engages with the engaging portion 29*a* of the support member 21 thereby to temporarily hold the bell crank 31 at the assembly position. When the bell crank 31 is at the assembly position, the handle 55 is attachable to the support member 21 in such a manner that the pressing portion 65 is in contact with the pressed portion 33*a* of the bell crank 31. Further, when the handle is rotated towards the second operation position after the attaching operation of the handle 55 to the support member 21 is completed, the engagement portion 48 of the temporary hold member 40 becomes separated from the engaging portion 29*a* of the support member 21. Accordingly, the temporary member 40 that has been biased towards the no-hold position moves to the no-hold position automatically.

When the bell crank 31 positioned at the second initial position is rotated towards the second operation position relative to the assembly position by performing the rotational operation on the handle 55, the bell crank operation force F, which is the predetermined force, might be transmitted from the lock apparatus 13 to the bell crank 31. The temporary hold member 40 of the disclosure, however, is configured to slide relative to the bell crank 31 between the no-hold position and the temporary hold position. Thus, the bell crank operation force F does not act between the temporary hold member 40 and the bell crank 31. Further, the temporary hold member 40 is biased to move to the no-hold position relative to the bell crank 31. Accordingly, the temporary hold member 40 is not moved, by the bell crank operation force F that has been transmitted to the bell crank 31, from the no-hold position relative to the bell crank 31. Consequently, thereafter, when the handle 55 is operated to rotate in the direction which causes the bell crank 31 to rotate to the second initial position, the bell crank 31 rotates to the second initial position reliably.

According to the aforementioned embodiment, the range in which the bell crank 31 is configured to move relative to the support member 21 in the direction that is parallel with the sliding direction of the temporary hold member 40 is limited to the range in which the engagement portion 48 of the temporary hold member 40 positioned in the first position is unable to engage with the engaging portion 29*a*.

According to the above-described configuration, even in a case where the bell crank 31 is movable relative to the support member 21 in the direction that is parallel with the sliding direction of the temporary hold member 40, when the temporary hold member 40 is positioned at the no-hold position, the engagement portion 48 of the temporary hold member 40 and the engaging portion 29*a* of the support member 21 do not engage with each other regardless of the rotational direction position of the bell crank 31. Consequently, after the engagement portion 48 of the temporary hold member 40 has disengaged from the engaging portion 29*a* of the support member 21, when the handle 55 is operated to rotate in the direction which causes the bell crank 31 to rotate to the second initial position, the bell crank 31 rotates to the second initial position more reliably.

According to the aforementioned embodiment, the bell crank 31 includes the support portion 36 supporting the temporary hold member 40 in a manner that the temporary hold member 40 is slidable. The compression coil spring 50 (i.e., the biasing member) is provided between the support portion 36 and the temporary hold member 40, the compression coil spring 50 biasing the temporary hold member 40 such that the temporary hold member 40 moves to the first position. The temporary hold member 40 includes the stopper 46 engaging with the support portion 36 when the temporary hold member 40 is positioned at the first position and restricting the temporary hold member 40 from moving towards the side opposite to the second position.

According to the above-described embodiment, with the simple structure, the temporary hold member 40 positioned at the no-hold position can be restricted from moving to the side opposite to the temporary hold position.

According to the aforementioned embodiment, the support portion 36 includes the cylindrical body extended in the direction which is parallel with the sliding direction of the temporary hold member 40 and provided with the stopper hole 38 formed at the inner circumferential surface of the cylindrical body. The temporary hold member 40 is placed by insertion in the inside space portion of the support portion 36 to be slidable, and the stopper 46 is slidably positioned in the stopper hole 38 and is in contact with the stopper surface 39 corresponding to the portion of the inner surface of the stopper hole 38, such that the stopper 46 restricts the temporary hold member 40 from moving towards a side opposite to the second position.

According to the above-described embodiment, with the simple structure, the temporary hold member 40 positioned at the no-hold position can be restricted from moving to the side opposite to the temporary hold position.

According to the aforementioned embodiment, the biasing member corresponds to the compression coil spring 50 of which the axial direction is extended to be parallel with the sliding direction of the temporary hold member 40, and the compression coil spring 50 is held in a state in which the compression coil spring 50 is compressed between the support portion 36 and the temporary hold member 40 compared to the free state. The temporary hold member 40 includes the biasing member attachment portion 44 corresponding to the annular surface, the compression coil spring 50 is arranged at the outer circumferential side of the biasing member attachment portion 44, the position of the biasing member attachment portion 44 in the axial direction is different from the position of the stopper 46 in the axial direction, and the stopper 46 is positioned at the inner circumferential side of the biasing member attachment portion 44 when the temporary hold member 40 is viewed in the axial direction.

According to the above-described configuration, when the compression coil spring 50 is being attached to the temporary hold member 40 so as to be arranged at the outer circumferential side of the biasing member attachment portion 44, a possibility that the compression coil spring 50 interferes with the stopper 46 can be reduced. In other words, the compression coil spring 50 is attached to the temporary hold member 40 easily.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A handle apparatus for a vehicle, the apparatus comprising:

a support member configured to be fixed to a vehicle door including a lock apparatus;

a bell crank supported by the support member to be rotatable between an initial position and an operation position, in a state where the bell crank is linked to the lock apparatus, the bell crank causing the lock apparatus to be in a latched state when the bell crank is in the initial position and causing the lock apparatus to be in an unlatched state when the bell crank is in the operation position, the latched state being configured to hold the vehicle door in a closed state, the unlatched state being configured to permit the vehicle door to open;

a handle including a pressing portion, in a case where the handle is rotatably attached to the support member in a state where the pressing portion is in contact with a pressed portion provided at the bell crank, the handle causing, via the pressed portion and the pressing portion, the bell crank to rotate between the initial position and the operation position when the handle rotates;

a temporary hold member supported by the bell crank in such a manner that the temporary hold member is slidable relative to the bell crank between a first position and a second position and that the temporary hold member is biased to move to the first position, the temporary hold member including an engagement portion configured to engage with an engaging portion provided at the support member when the temporary hold member is in the second position; and the temporary hold member is configured to hold the bell crank for a predetermined time in an assembly position between the initial position and the operation position by engaging the engagement portion of the support member.

2. The handle apparatus for a vehicle according to claim 1, wherein a range in which the bell crank is configured to move relative to the support member in a direction that is parallel with a sliding direction of the temporary hold member is limited to a range in which the engagement portion of the temporary hold member positioned in the first position is unable to engage with the engaging portion.

3. The handle apparatus for a vehicle according to claim 1, wherein the bell crank includes a support portion supporting the temporary hold member in a manner that the temporary hold member is slidable;

a biasing member is provided between the support portion and the temporary hold member, the biasing member biasing the temporary hold member such that the temporary hold member moves to the first position; and the temporary hold member includes a stopper engaging with the support portion when the temporary hold member is positioned in the first position and restricting the temporary hold member from moving towards a side opposite to the second position.

4. The handle apparatus for a vehicle according to claim 2, wherein the bell crank includes a support portion supporting the temporary hold member in a manner that the temporary hold member is slidable;

a biasing member is provided between the support portion and the temporary hold member, the biasing member biasing the temporary hold member such that the temporary hold member moves to the first position; and the temporary hold member includes a stopper engaging with the support portion when the temporary hold member is positioned in the first position and restricting the temporary hold member from moving towards a side opposite to the second position.

5. The handle apparatus for a vehicle according to claim 3, wherein the support portion includes a cylindrical body extended in a direction which is parallel with a sliding direction of the temporary hold member and provided with a stopper hole formed at an inner circumferential surface of the cylindrical body, the temporary hold member is placed by insertion in an inside space portion of the support portion to be slidable, and the stopper is slidably positioned in the stopper hole and is in contact with a stopper surface corresponding to a portion of an inner surface of the stopper hole, such that the stopper restricts the temporary hold member from moving towards a side opposite to the second position.

6. The handle apparatus for a vehicle according to claim 4, wherein the support portion includes a cylindrical body extended in a direction which is parallel with the sliding direction of the temporary hold member and provided with a stopper hole formed at an inner circumferential surface of the cylindrical body, the temporary hold member is placed by insertion in an inside space portion of the support portion to be slidable, and the stopper is slidably positioned in the stopper hole and is in contact with a stopper surface corresponding to a portion of an inner surface of the stopper hole, such that the stopper restricts the temporary hold member from moving towards a side opposite to the second position.

7. The handle apparatus for a vehicle according to claim 4, wherein the biasing member corresponds to a compression coil spring of which an axial direction is extended to be parallel with the sliding direction of the temporary hold member, and the compression coil spring is held in a state in which the compression coil spring is compressed between the support portion and the temporary hold member compared to a free state, the temporary hold member includes a biasing member attachment portion corresponding to an annular surface, the compression coil spring is arranged at an outer circumferential side of the biasing member attachment portion, a position of the biasing member attachment portion in the axial direction is different from a position of the stopper in the axial direction, and the stopper is positioned at an inner circumferential side of the biasing member attachment portion when the temporary hold member is viewed in the axial direction.

8. The handle apparatus for a vehicle according to claim 5, wherein the biasing member corresponds to a compression coil spring of which an axial direction is extended to be parallel with the sliding direction of the temporary hold member, and the compression coil spring is held in a state in which the compression coil spring is compressed between the support portion and the temporary hold member compared to a free state, the temporary hold member includes a biasing member attachment portion corresponding to an annular surface, the compression coil spring is arranged at an outer circumferential side of the biasing member attachment portion, a position of the biasing member attachment portion in the axial direction is different from a position of the stopper in the axial direction, and the stopper is positioned at an inner circumferential side of the biasing member attachment portion when the temporary hold member is viewed in the axial direction.

9. The handle apparatus for a vehicle according to claim 6, wherein the biasing member corresponds to a compression coil spring of which an axial direction is extended to be parallel with the sliding direction of the temporary hold member, and the compression coil spring is held in a state in which the compression coil spring is compressed between the support portion and the temporary hold member compared to a free state, the temporary hold member includes a biasing member attachment portion corresponding to an annular surface, the compression coil spring is arranged at an outer circumferential side of the biasing member attachment portion, a position of the biasing member attachment portion in the axial direction is different from a position of the stopper in the axial direction, and the stopper is positioned at an inner circumferential side of the biasing member attachment portion when the temporary hold member is viewed in the axial direction.

10. The handle apparatus for a vehicle according to claim 3, wherein the biasing member corresponds to a compression coil spring of which an axial direction is extended to be parallel with a sliding direction of the temporary hold member, and the compression coil spring is held in a state in which the compression coil spring is compressed between the support portion and the temporary hold member compared to a free state, the temporary hold member includes a biasing member attachment portion corresponding to an annular surface, the compression coil spring is arranged at an outer circumferential side of the biasing member attachment portion, a position of the biasing member attachment portion in the axial direction is different from a position of the stopper in the axial direction, and the stopper is positioned at an inner circumferential side of the biasing member attachment portion when the temporary hold member is viewed in the axial direction.

* * * * *